US005317819A

United States Patent [19]

Ellis, III

[11] Patent Number: 5,317,819

[45] Date of Patent: Jun. 7, 1994

[54] SHOE WITH NATURALLY CONTOURED SOLE

[76] Inventor: Frampton E. Ellis, III, 2895 S. Abingdon St., Suite B-2, Arlington, Va. 22206

[21] Appl. No.: 930,469

[22] Filed: Aug. 20, 1992

Related U.S. Application Data

[63] Continuation of Ser. No. 239,667, Sep. 2, 1988, abandoned.

[51] Int. Cl.[5] ..... A43B 13/14

[52] U.S. Cl. ..... 36/25 R; 36/30 R; 36/31; 36/114; 36/88

[58] Field of Search ..... 36/25 R, 30 R, 28, 31, 36/32 R, 88, 91, 114, 127, 129, 69

[56] References Cited

U.S. PATENT DOCUMENTS

| | | | |
|---|---|---|---|
| 288,127 | 11/1883 | Shepard | 36/32 R |
| 1,289,106 | 12/1918 | Bullock . | |
| 2,120,987 | 6/1938 | Murray | 12/142 P |
| 2,328,242 | 8/1943 | Witherill | 36/25 R |
| 3,305,947 | 2/1967 | Kalsoy | 36/91 |
| 3,308,560 | 3/1967 | Jones . | |
| 4,083,125 | 4/1978 | Benseler et al. | 36/32 R |
| 4,128,951 | 12/1978 | Tansill . | |
| 4,141,158 | 2/1979 | Benseler et al. | 36/32 R |
| 4,262,433 | 4/1981 | Hagg et al. | 36/25 R |
| 4,305,212 | 12/1981 | Coomer | 36/29 |
| 4,309,832 | 1/1982 | Hunt | 36/32 R |
| 4,342,161 | 8/1982 | Schmohl | 36/114 |
| 4,449,306 | 5/1984 | Cavanagh | 36/30 |
| 4,455,767 | 6/1984 | Bergmans | 36/32 R |
| 4,557,059 | 12/1985 | Misevich et al. | 36/32 |
| 4,578,882 | 4/1986 | Talarico, II | 36/25 R |
| 4,676,010 | 6/1987 | Cheskin | 36/32 R |
| 4,694,591 | 9/1987 | Banich et al. | 36/31 |
| 4,715,133 | 12/1987 | Hartjes et al. | 36/127 |
| 4,724,622 | 2/1988 | Mills | 36/30 R |
| 4,727,660 | 3/1988 | Bernhard | 36/32 R |
| 4,748,753 | 6/1988 | Ju | 36/134 |
| 4,858,340 | 8/1989 | Pasternak | 36/88 |
| 4,989,349 | 2/1991 | Ellis, III | 36/25 R |

FOREIGN PATENT DOCUMENTS

| | | | |
|---|---|---|---|
| 0048965 | 4/1982 | European Pat. Off. | 36/88 |
| 0185781 | 7/1986 | European Pat. Off. | 36/25 R |
| 1290844 | 3/1969 | Fed. Rep. of Germany | 36/32 R |
| 602501 | 12/1925 | France | 36/31 |
| 1004472 | 11/1951 | France . | |
| 59-23525 | 7/1984 | Japan | 36/25 R |
| 764956 | 1/1957 | United Kingdom | 36/25 R |
| 2136670 | 9/1984 | United Kingdom | 36/114 |

OTHER PUBLICATIONS

B 23 257 VII/71A, May 1956, German Published Application (Bianchi).

Benno M. Nigg and M. Morlock, "The Influence of Lateral Heel Flare of Running Shoes on Pronation and Impact Forces", *Medicine and Science in Sports and Exercise*, Vol. 19, No. 3, (1987), pp. 294–302.

*Primary Examiner*—Paul T. Sewell
*Assistant Examiner*—M. D. Patterson
*Attorney, Agent, or Firm*—Ronald P. Kananen

[57] ABSTRACT

A construction for a shoe, particularly an athletic shoe such as a running shoe, includes a sole that conforms to the natural shape of the foot, particularly the sides, and that has a constant thickness in frontal plane cross sections. The thickness of the shoe sole side contour equals and therefore varies exactly as the thickness of the load-bearing sole portion varies due to heel lift, for example. Thus, the outer contour of the edge portion of the sole has at least a portion which lies along a theoretically ideal stability plane for providing natural stability and efficient motion of the shoe and foot particularly in an inverted and everted mode.

29 Claims, 18 Drawing Sheets

FIG. 1
(PRIOR ART)
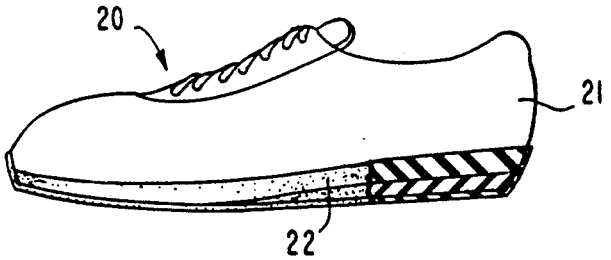
FIG. 2A
(PRIOR ART)
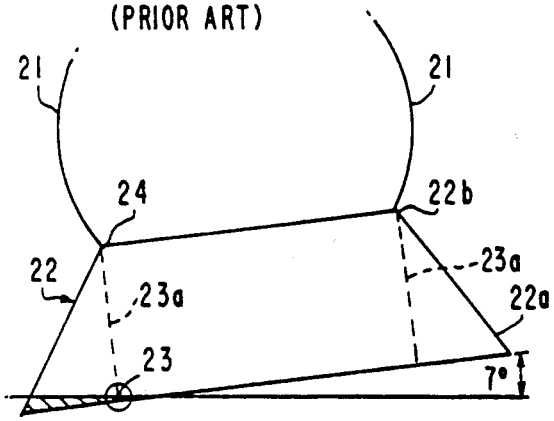
FIG. 2
FIG. 2B
(PRIOR ART)
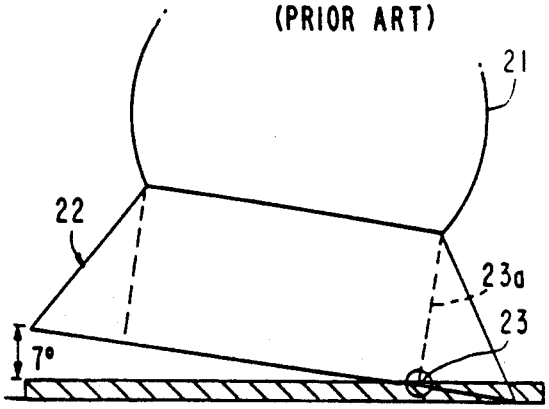
FIG. 2C
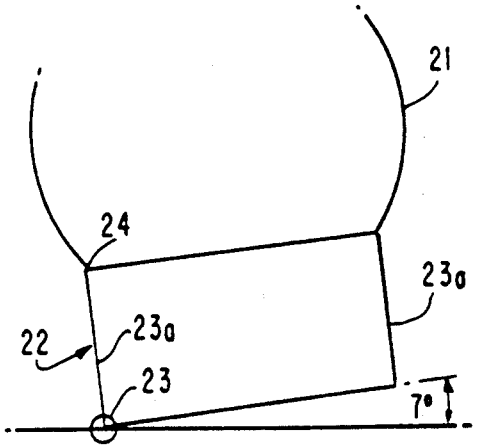
FIG. 2D
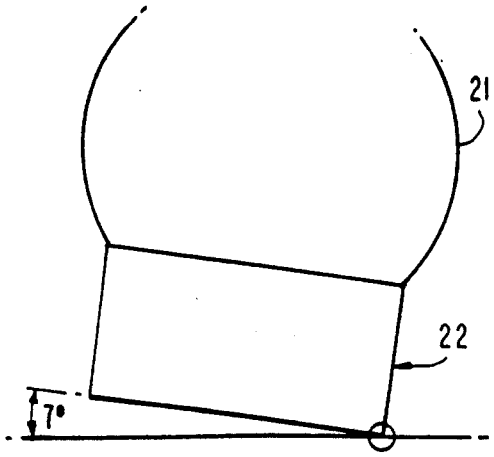

FIG. 5
FIG. 5A
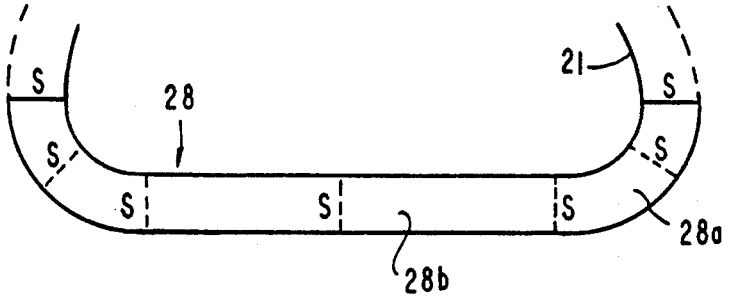
FIG. 5B
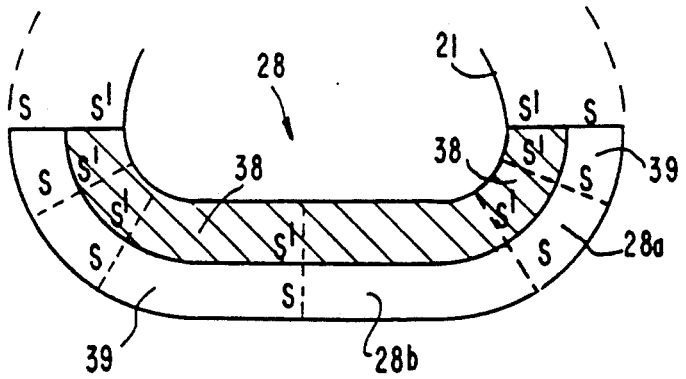
FIG. 6
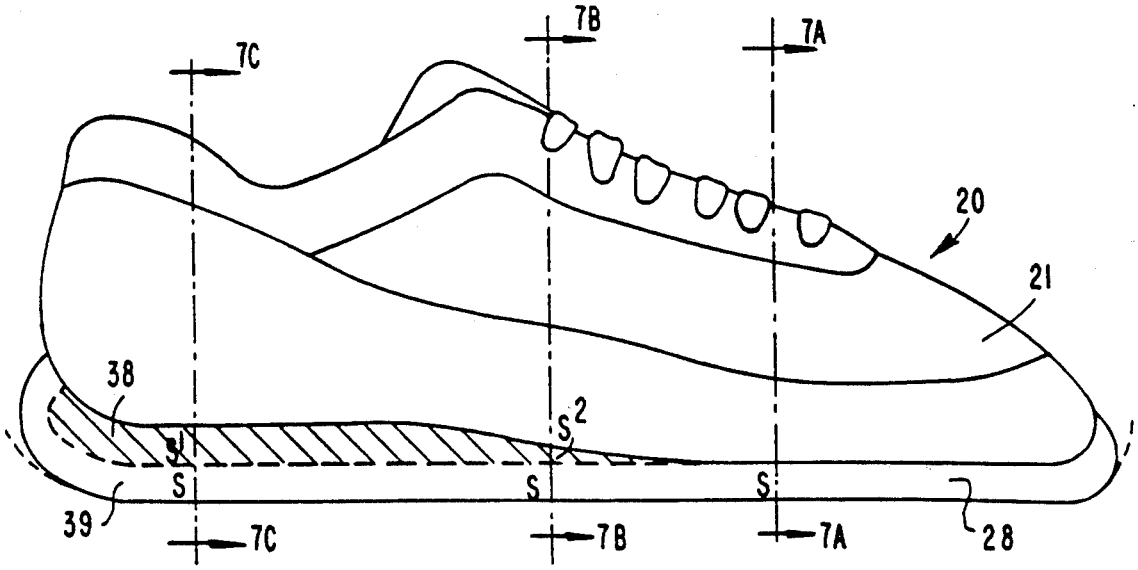

FIG. 7A
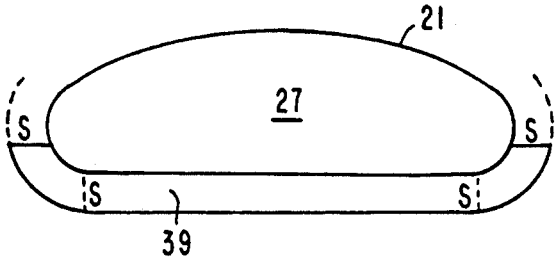
FIG. 7B
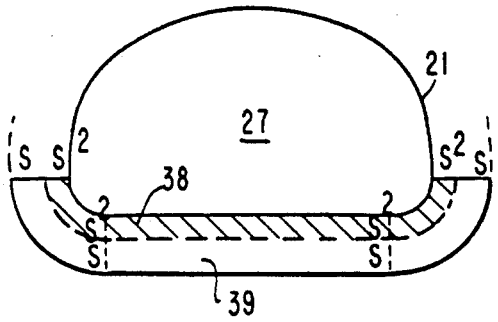
FIG. 7C
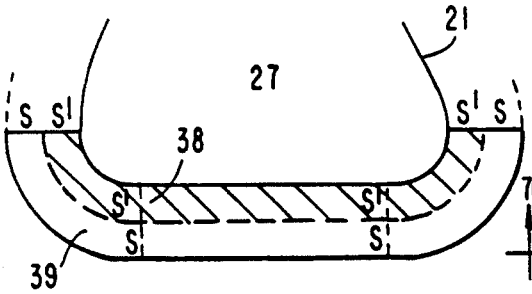
FIG. 7
FIG. 7D
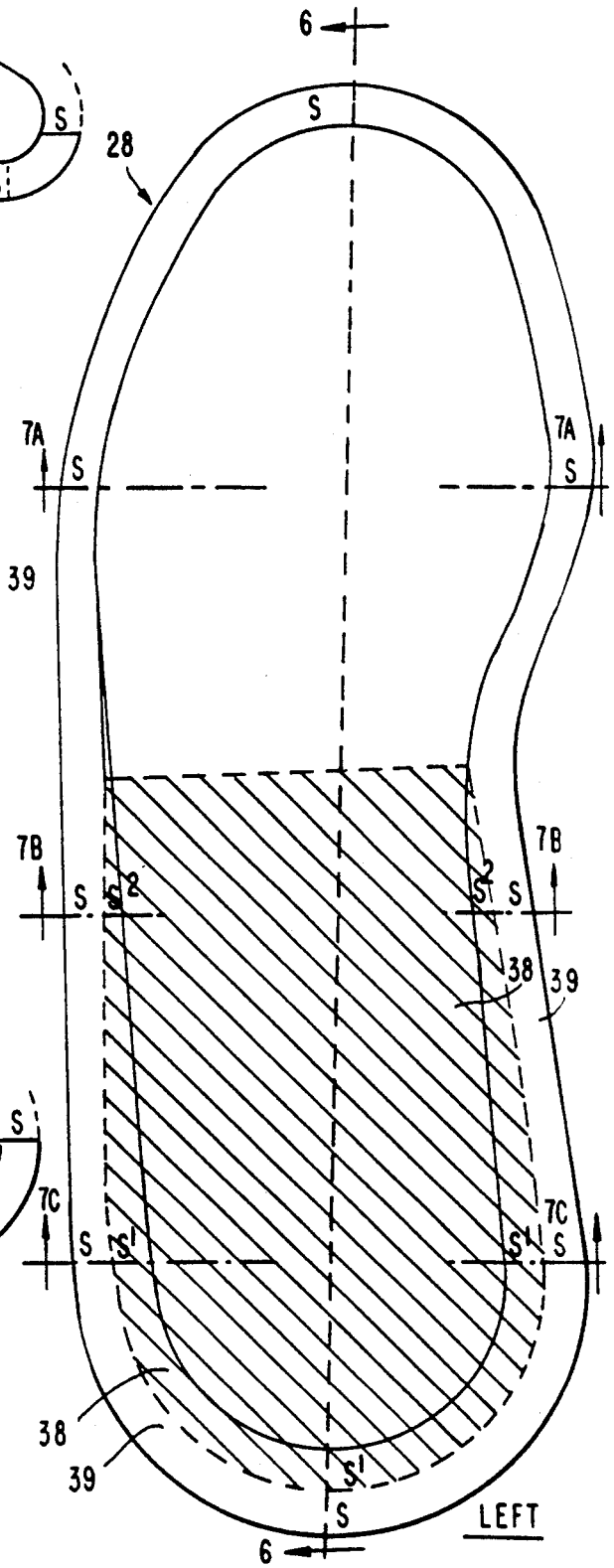

FIG. 8
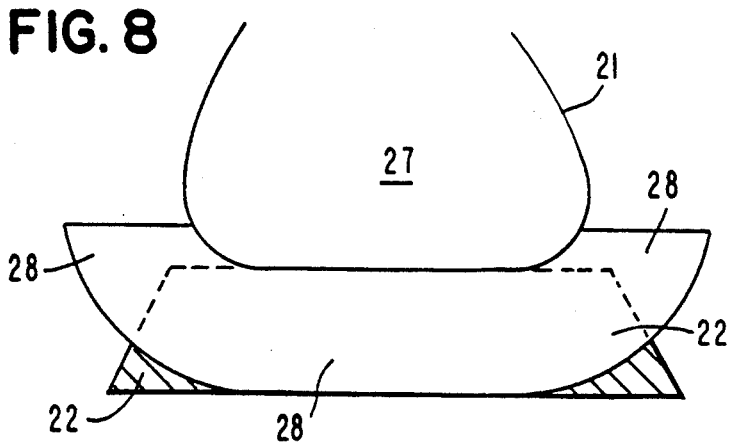
FIG. 9
FIG. 9A
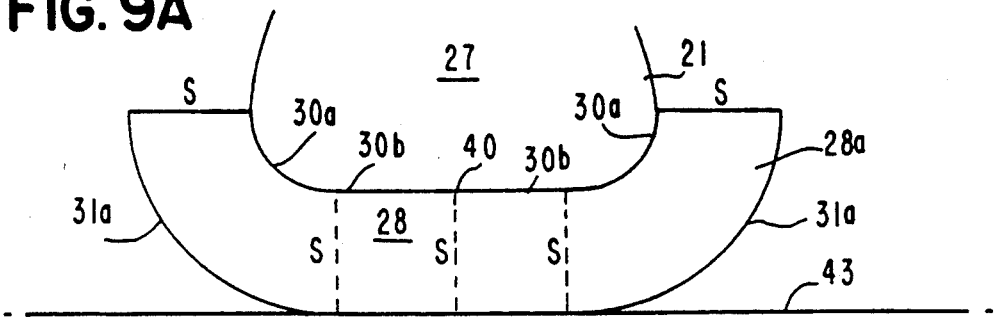
FIG. 9B
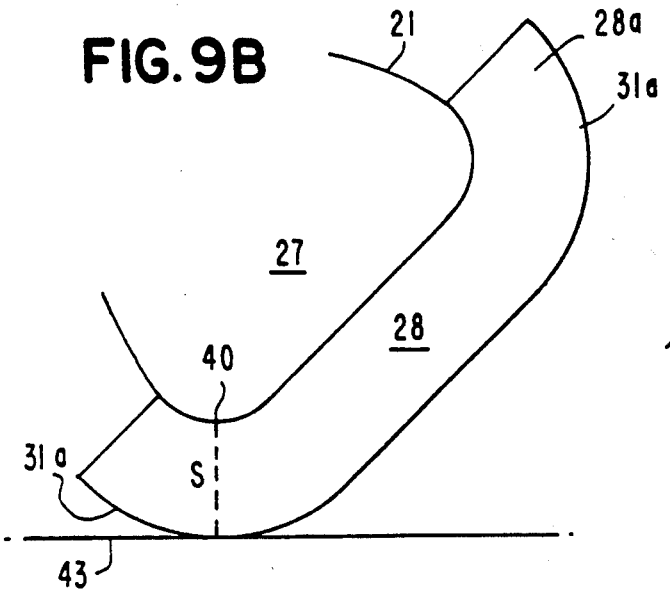
FIG. 9C
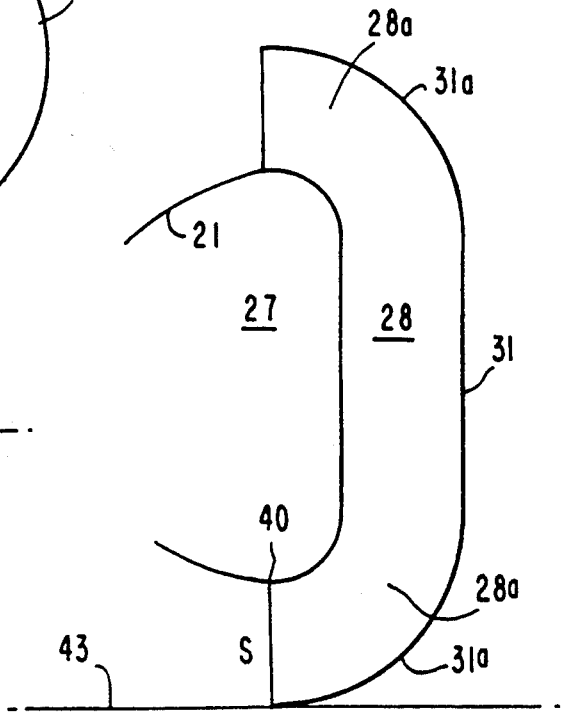

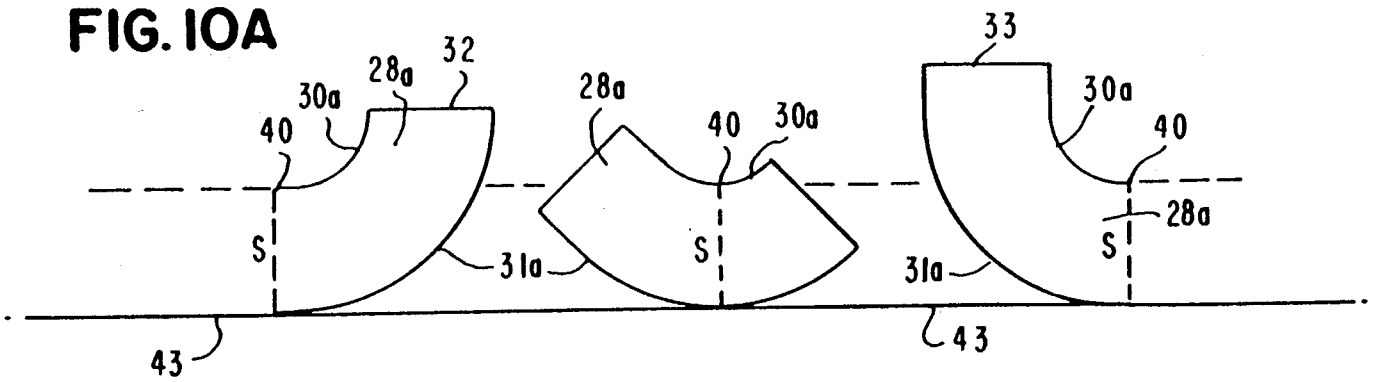
FIG. 10
FIG. 10A
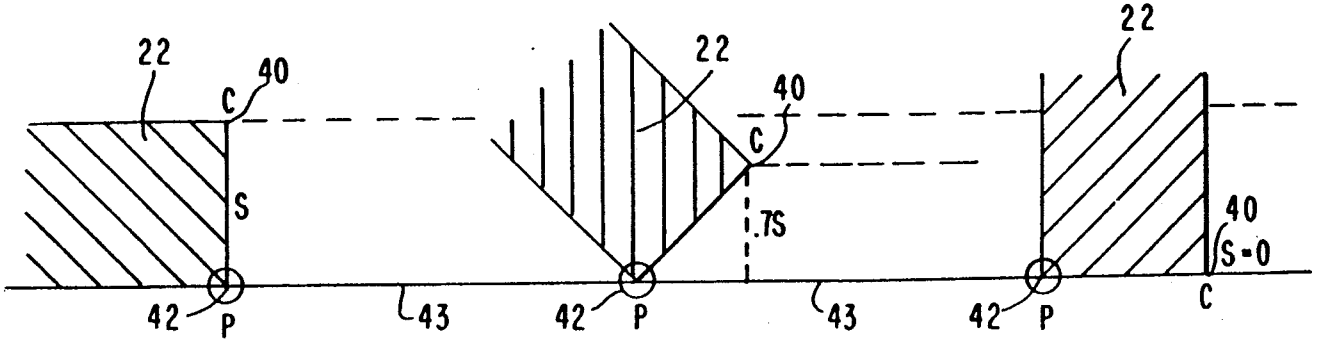
FIG. 10B

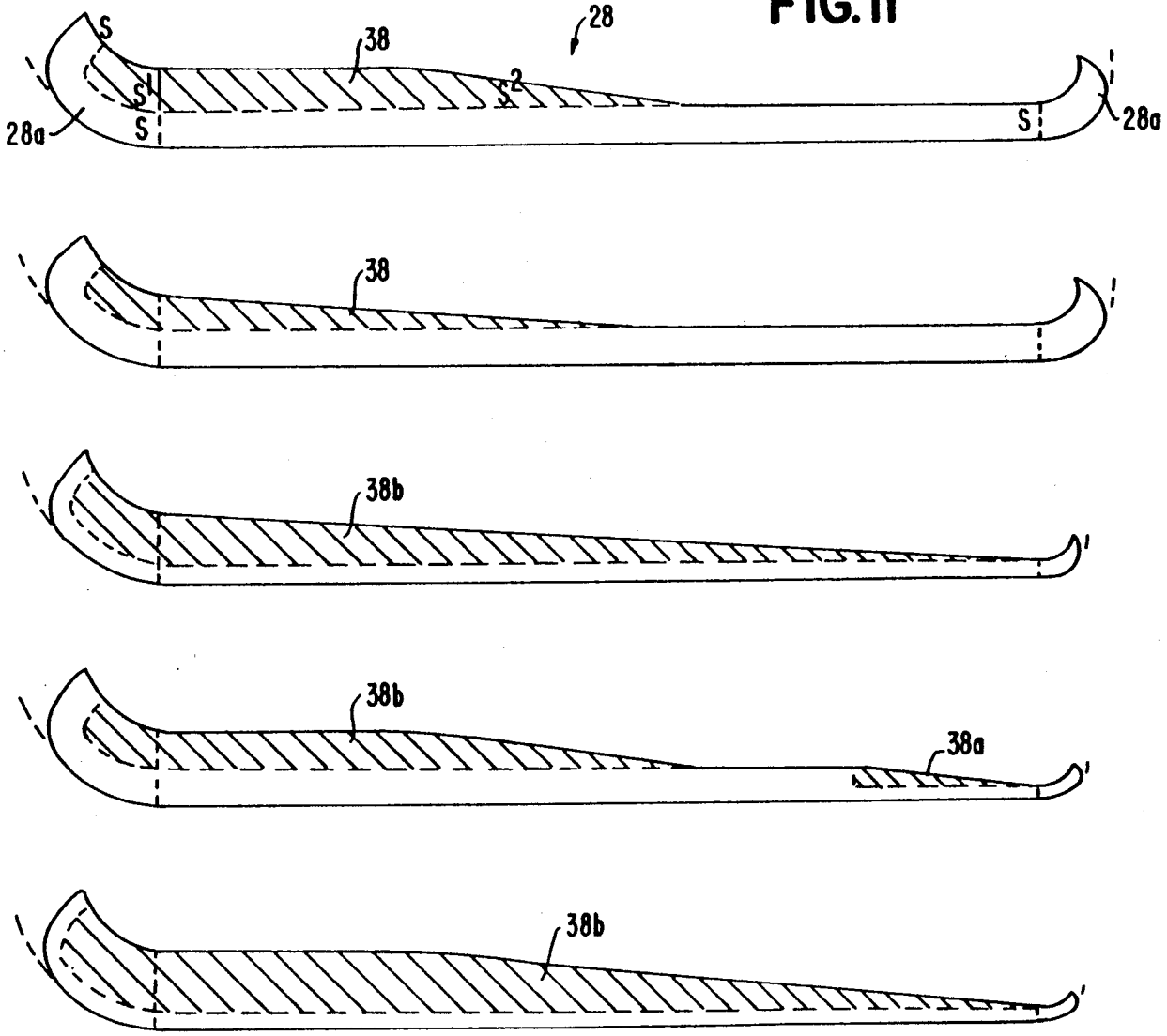
FIG. II
FIG. IIA
FIG. IIB
FIG. IIC
FIG. IID
FIG. IIE

FIG. 12
FIG. 12A
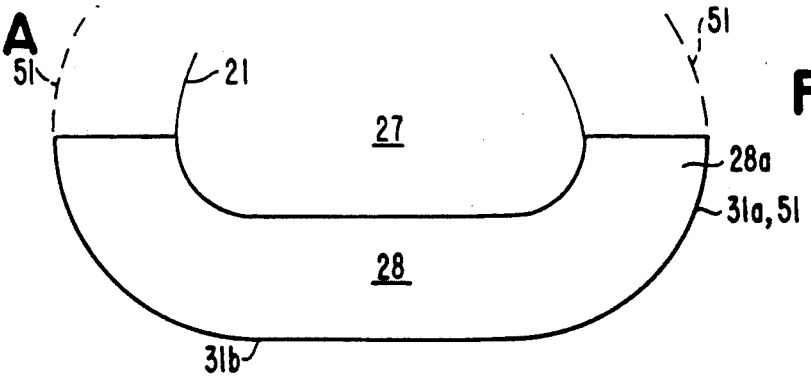
FIG. 12B
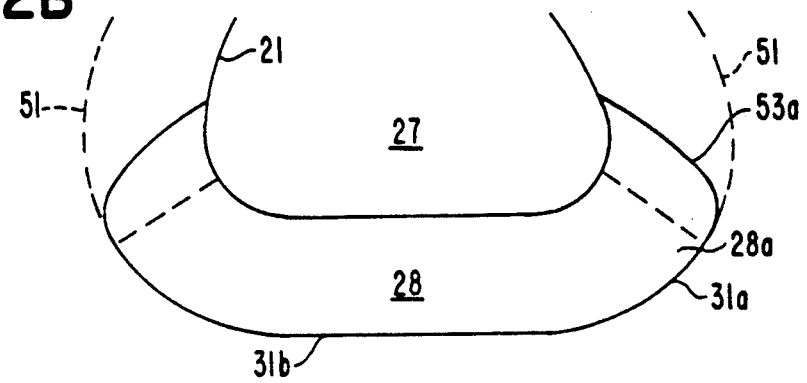
FIG. 12C
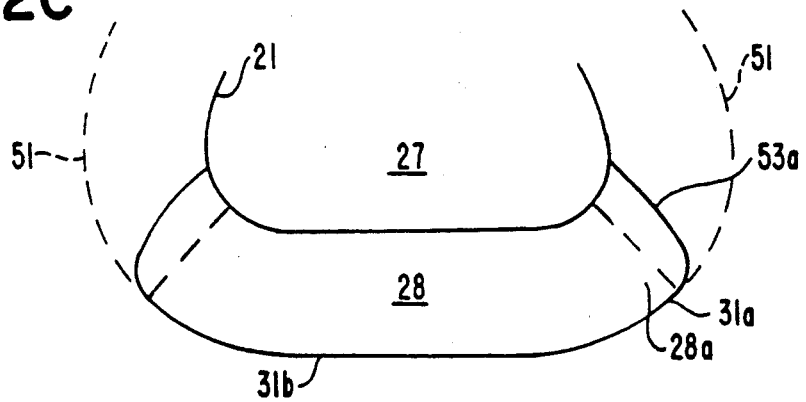
FIG. 12D
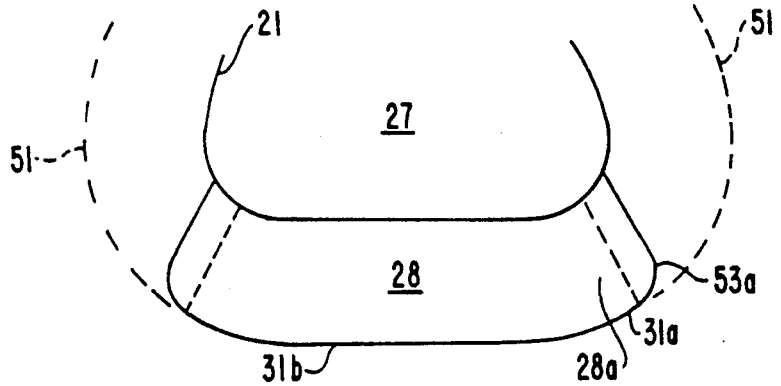

FIG. 13
FIG. 13A
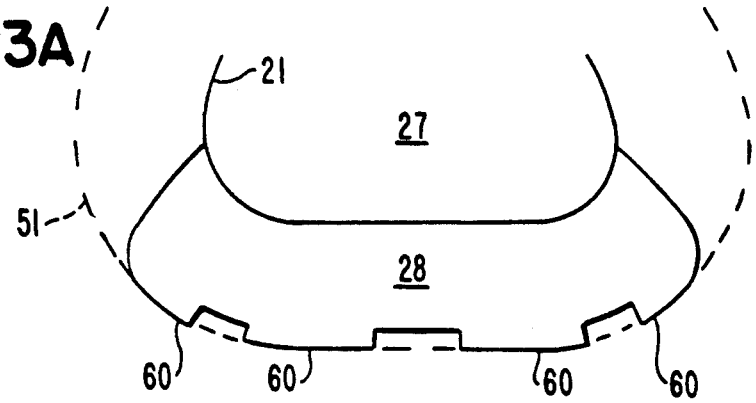
FIG. 13B
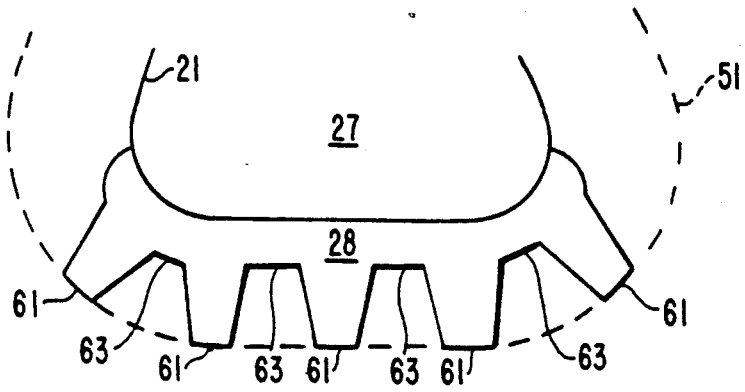
FIG. 13C
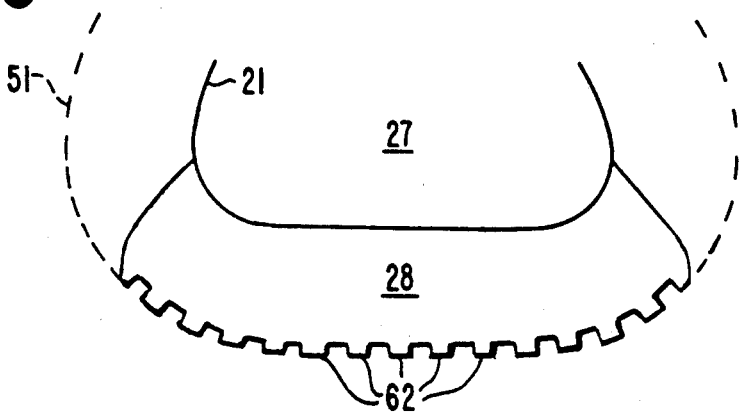

FIG. 18
FIG. 18A
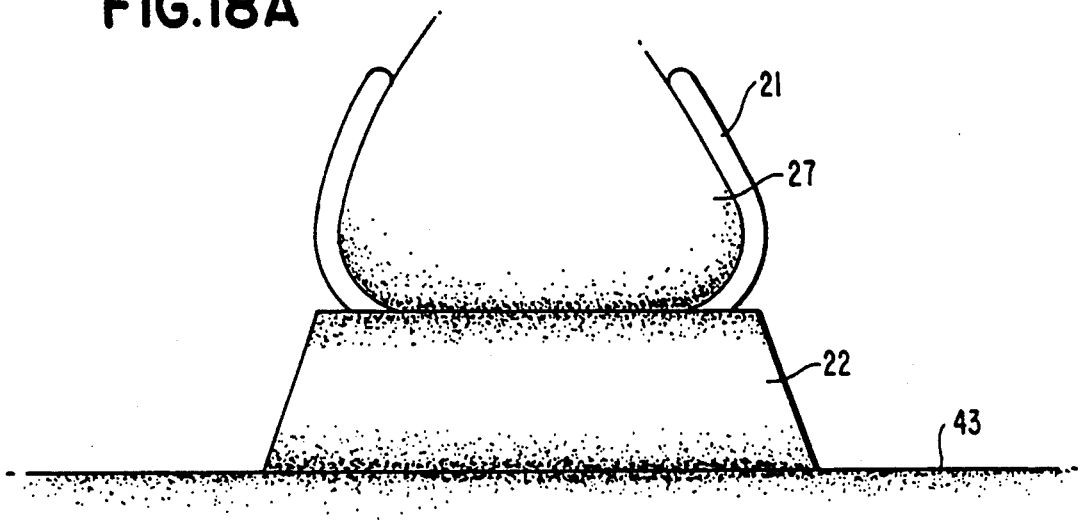
FIG. 18B
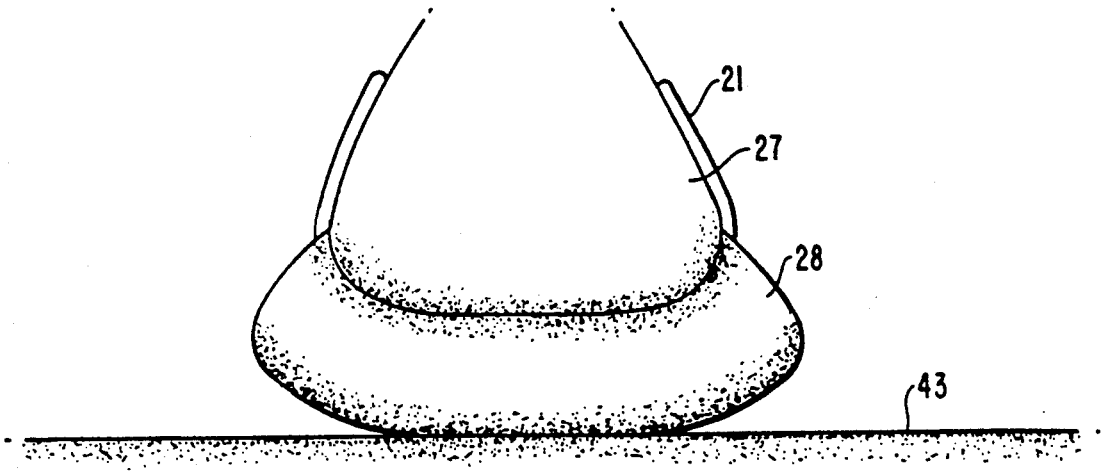

FIG. 19A
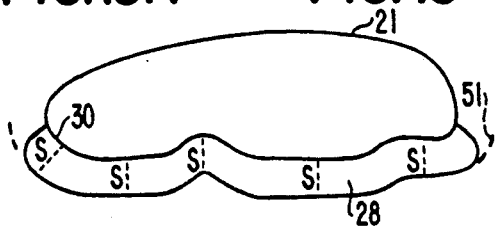
FIG. 19
FIG. 19B
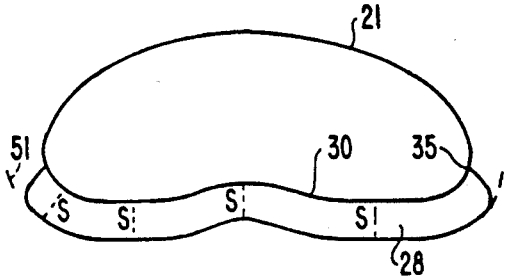
FIG. 19C
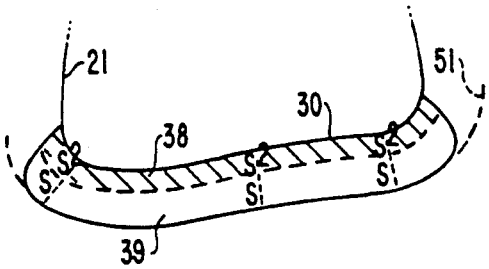
FIG. 19D
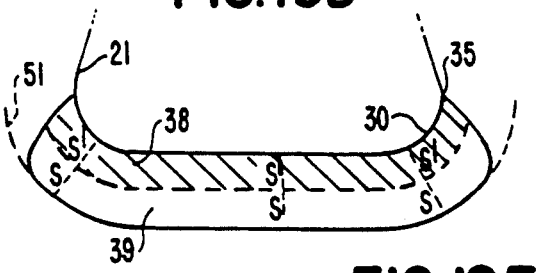
FIG. 19F
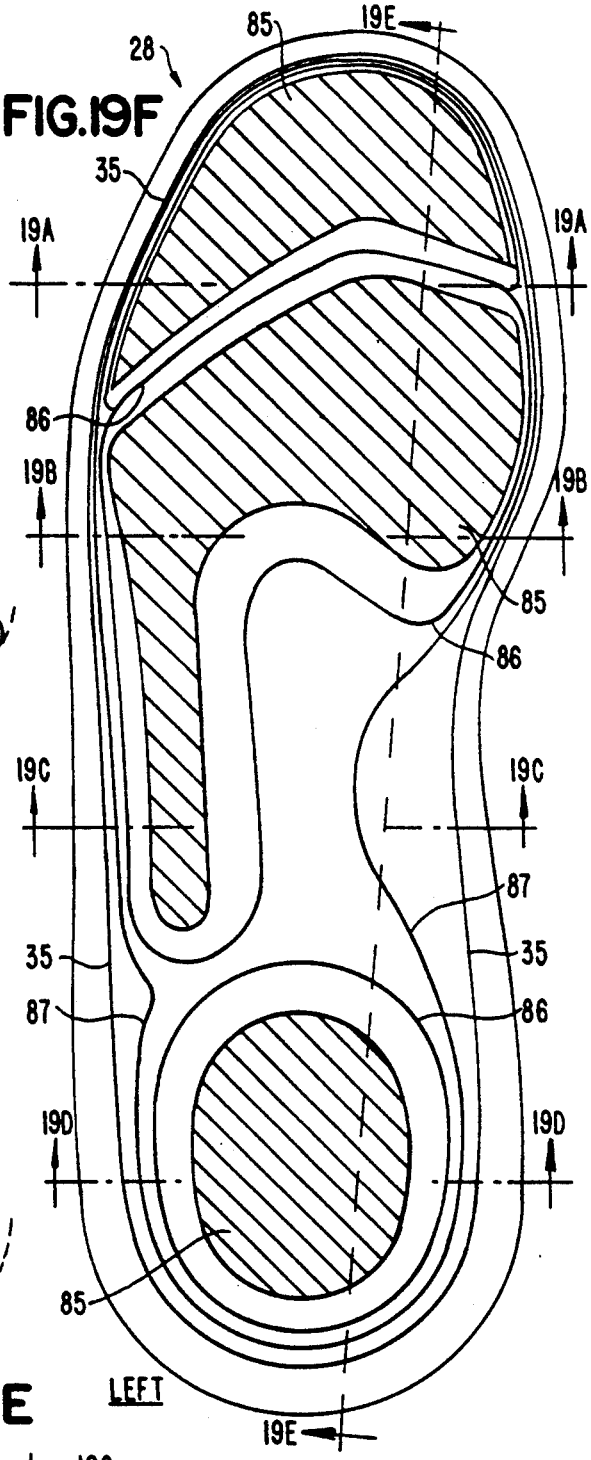
FIG. 19E
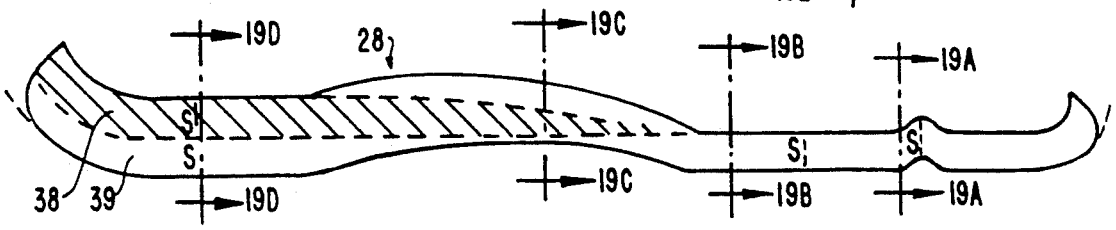

FIG. 20A
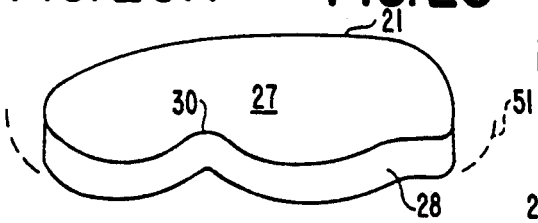
FIG. 20
FIG. 21
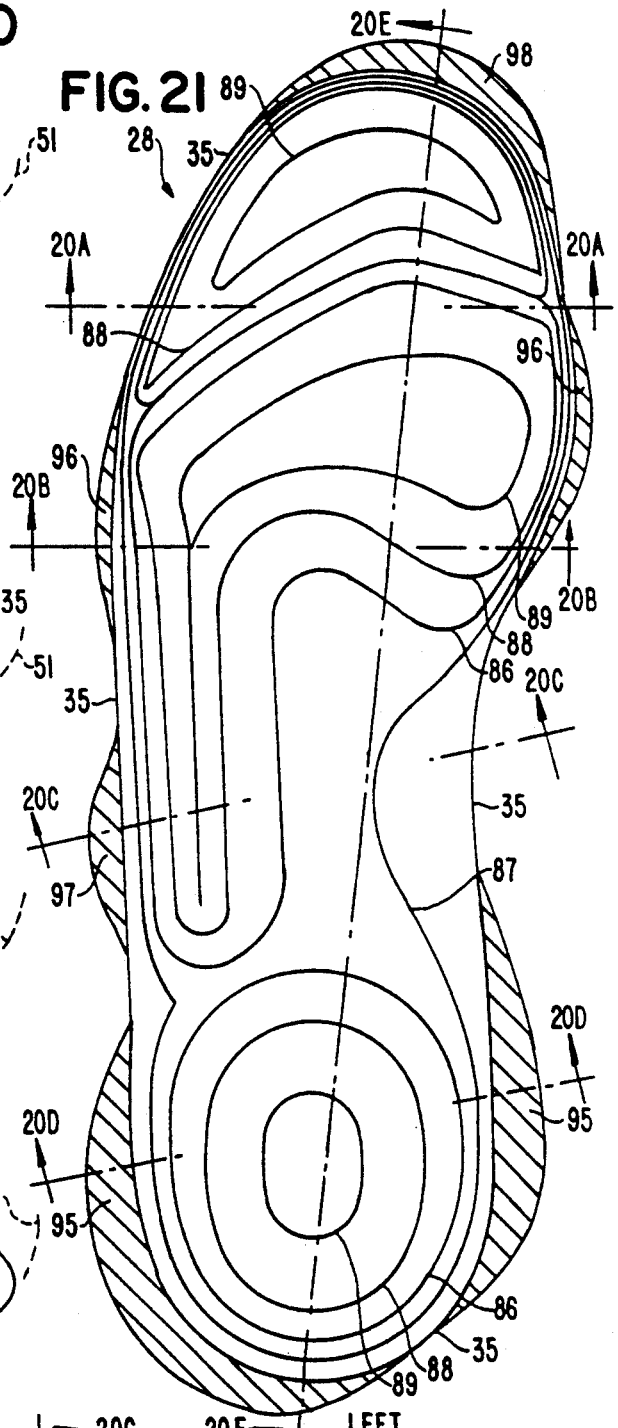
FIG. 20B
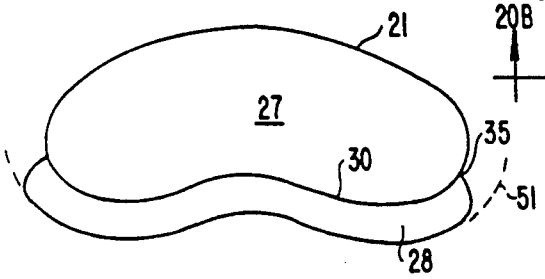
FIG. 20C
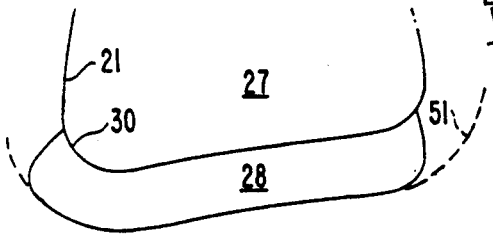
FIG. 20D
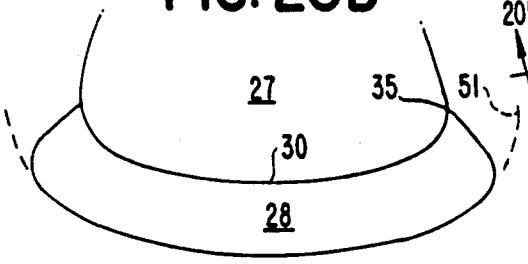
FIG. 20E
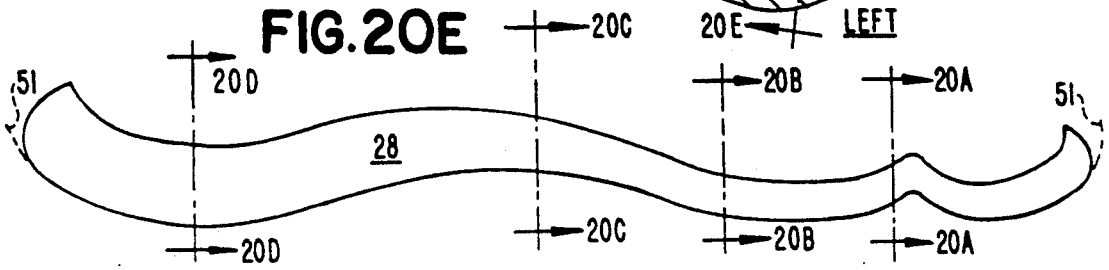

FIG. 22
FIG. 22A
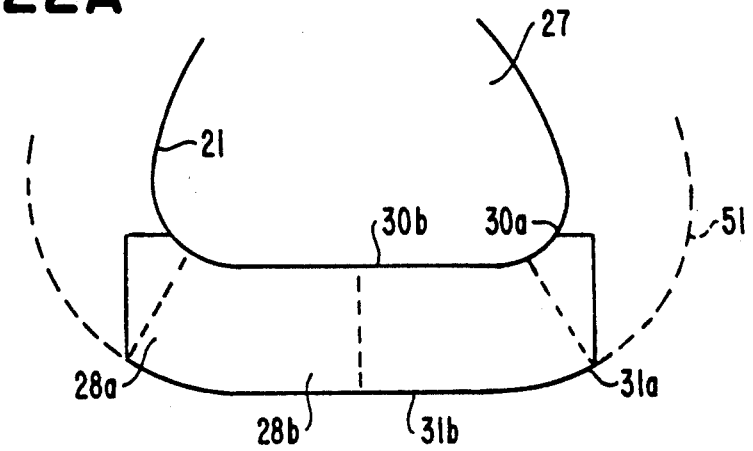
FIG. 22B
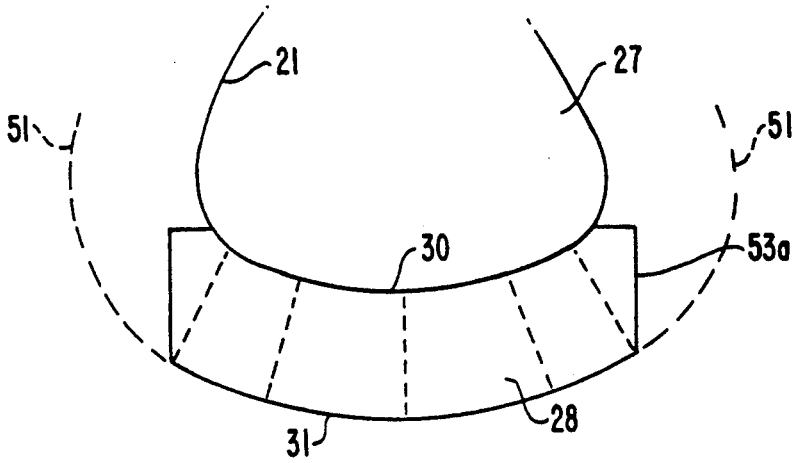

FIG. 23
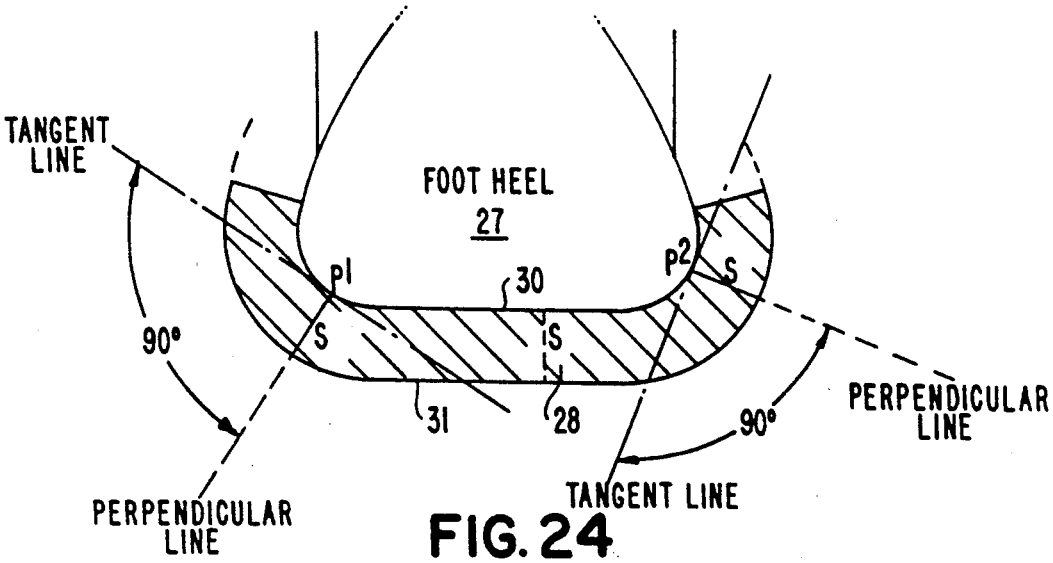
FIG. 24
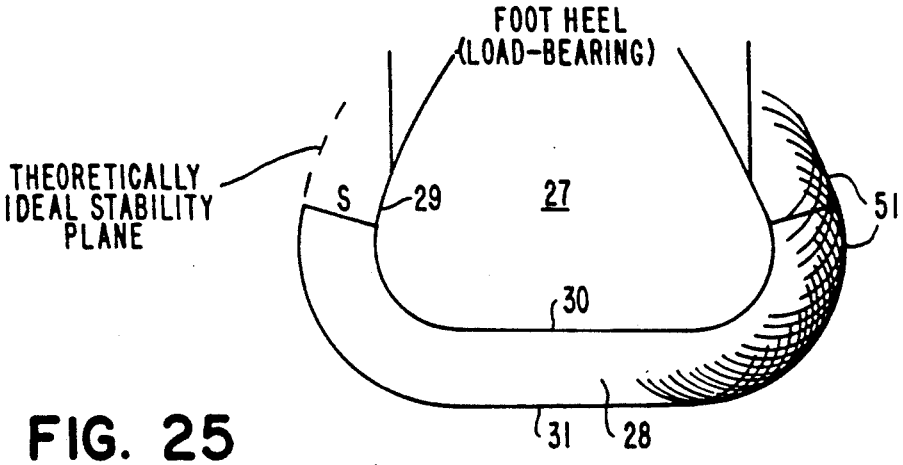
FIG. 25
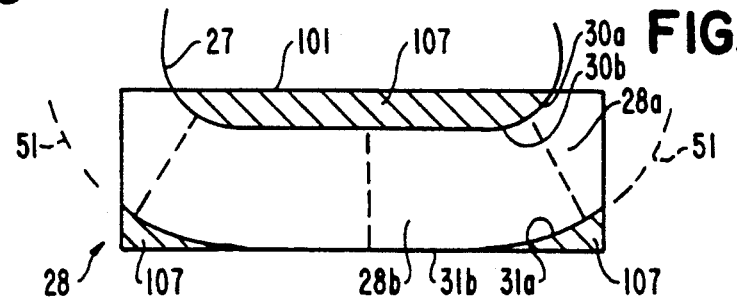
FIG. 25A
FIG. 25B
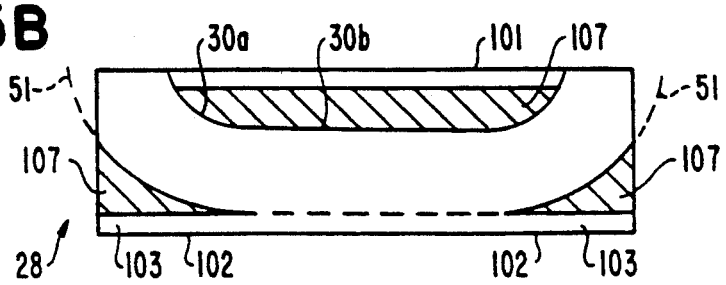

FIG.26
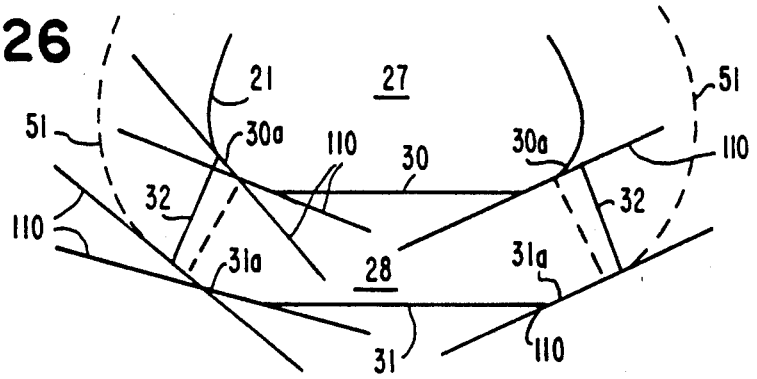
FIG. 27
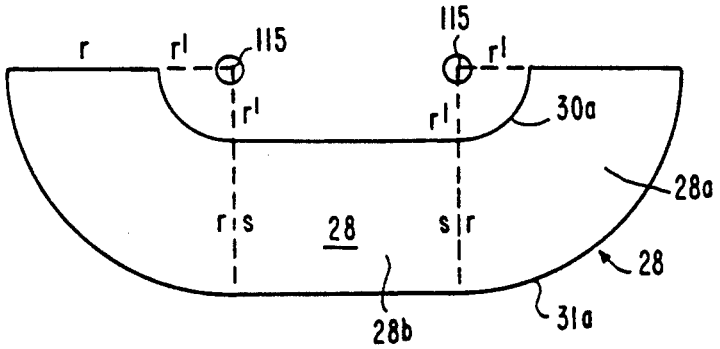
FIG. 28A
FIG. 28
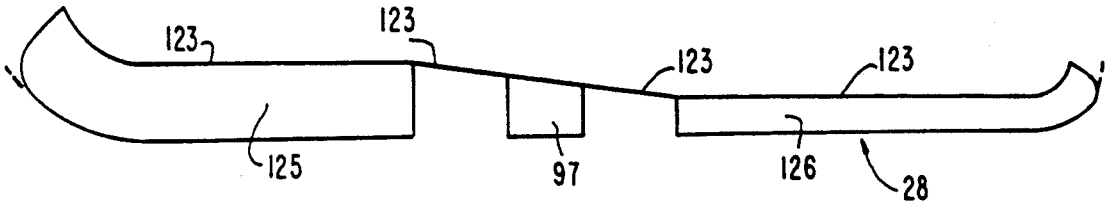
FIG. 28B
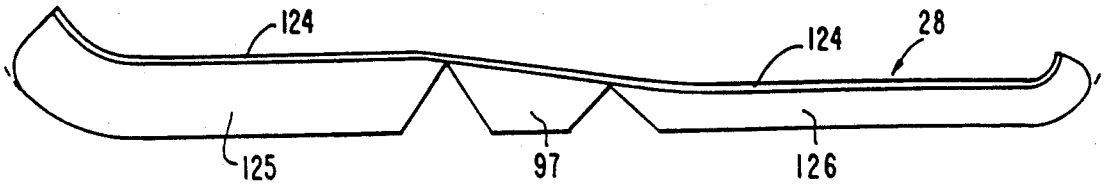

SHOE WITH NATURALLY CONTOURED SOLE

This application is a continuation of application Ser. No. 07/239,667 filed Sep. 2, 1988 now abandoned.

BACKGROUND OF THE INVENTION

This invention relates to a shoe, such as a street shoe, athletic shoe, and especially a running shoe with a contoured sole. More particularly, this invention relates to a novel contoured sole design for a running shoe which improves the inherent stability and efficient motion of the shod foot in extreme exercise. Still more particularly, this invention relates to a running shoe wherein the shoe sole conforms to the natural shape of the foot, particularly the sides, and has a constant thickness in frontal plane cross sections, permitting the foot to react naturally with the ground as it would if the foot were bare, while continuing to protect and cushion the foot.

By way of introduction, barefoot populations universally have a very low incidence of running "overuse" injuries, despite very high activity levels. In contrast, such injuries are very common in shoe shod populations, even for activity levels well below "overuse". Thus, it is a continuing problem with a shod population to reduce or eliminate such injuries and to improve the cushioning and protection for the foot. It is primarily to an understanding of the reasons for such problems and to proposing a novel solution according to the invention to which this improved shoe is directed.

A wide variety of designs are available for running shoes which are intended to provide stability, but which lead to a constraint in the natural efficient motion of the foot and ankle. However, such designs which can accommodate free, flexible motion in contrast create a lack of control or stability. A popular existing shoe design incorporates an inverted, outwardly-flared shoe sole wherein the ground engaging surface is wider than the heel engaging portion. However, such shoes are unstable in extreme situations because the shoe sole, when inverted or on edge, immediately becomes supported only by the sharp bottom sole edge where the entire weight of the body, multiplied by a factor of approximately three at running peak, is concentrated. Since an unnatural lever arm and force moment are created under such conditions, the foot and ankle are destabilized and, in the extreme, beyond a certain point of rotation about the pivot point of the shoe sole edge, forcibly cause ankle strain. In contrast, the unshod foot is always in stable equilibrium without a comparable lever arm or force moment and, at its maximum range of inversion motion, about 20°, the base of support on the barefoot heel actually broadens substantially as the calcaneal tuberosity contacts the ground. This is in contrast to the conventionally available shoe sole bottom which maintains a sharp, unstable edge.

It is thus an overall objective of this invention to provide a novel shoe design which approximates the barefoot. It has been discovered, by investigating the most extreme range of ankle motion to near the point of ankle sprain, that the abnormal motion of an inversion ankle sprain, which is a tilting to the outside or an outward rotation of the foot, is accurately simulated while stationary. With this observation, it can be seen that the extreme range stability of the conventionally shod foot is distinctly inferior to the barefoot and that the shoe itself creates a gross instability which would otherwise not exist.

Even more important, a normal barefoot running motion, which approximately includes a 7° inversion and a 7° eversion motion, does not occur with shod feet, where a 30° inversion and eversion is common. Such a normal barefoot motion is geometrically unattainable because the average running shoe heel is approximately 60% larger than the width of the human heel. As a result, the shoe heel and the human heel cannot pivot together in a natural manner; rather, the human heel has to pivot within the shoe but is resisted from doing so by the shoe heel counter, motion control devices, and the lacing and binding of the shoe upper, as well as various types of anatomical supports interior to the shoe.

Thus, it is an overall objective to provide an improved shoe design which is not based on the inherent contradiction present in current shoe designs which make the goals of stability and efficient natural motion incompatible and even mutually exclusive. It is another overall object of the invention to provide a new contour design which simulates the natural barefoot motion in running and thus avoids the inherent contradictions in current designs.

It is another objective of this invention to provide a running shoe which overcomes the problem of the prior art.

It is another objective of this invention to provide a shoe wherein the outer extent of the flat portion of the sole of the shoe includes all of the support structures of the foot but which extends no further than the outer edge of the flat portion of the foot sole so that the transverse or horizontal plane outline of the top of the flat portion of the shoe sole coincides as nearly as possible with the load-bearing portion of the foot sole.

It is another objective of the invention to provide a shoe having a sole which includes a side contoured like the natural form of the side or edge of the human foot and conforming to it.

It is another objective of this invention to provide a novel shoe structure in which the contoured sole includes a shoe sole thickness that is precisely constant in frontal plane cross sections, and therefore biomechanically neutral, even if the shoe sole is tilted to either side, or forward or backward.

It is another objective of this invention to provide a shoe having a sole fully contoured like and conforming to the natural form of the non-load-bearing human foot and deforming under load by flattening just as the foot does.

It is still another objective of this invention to provide a new stable shoe design wherein the heel lift or wedge increases in the sagittal plane the thickness of the shoe sole or toe taper decrease therewith so that the sides of the shoe sole which naturally conform to the sides of the foot also increase or decrease by exactly the same amount, so that the thickness of the shoe sole in a frontal planar cross section is always constant.

These and other objectives of the invention will become apparent from a detailed description of the invention which follows taken in conjunction with the accompanying drawings.

BRIEF DESCRIPTION OF THE DRAWINGS

In the drawings:

FIG. 1 is a perspective view of a typical running shoe known to the prior art to which the invention is applicable;

FIG. 2 shows, in FIGS. 2A and 2B, the obstructed natural motion of the shoe heel in frontal planar cross section rotating inwardly or outwardly with the shoe sole having a flared bottom in a conventional prior art design such as in FIG. 1; and in FIGS. 2C and 2D, the efficient motion of a narrow rectangular shoe sole design;

FIG. 5 is diagrammatic sketch in FIGS. 5A and 5B, showing the novel contoured side sole design according to the invention with variable heel lift;

FIG. 6 is a side view of the novel stable contoured shoe according to the invention showing the contoured side design;

FIG. 7D is a top view of the shoe sole shown in FIG. 6, wherein FIG. 7A is a cross-sectional view of the forefoot portion taken along lines 7A of FIGS. 6 or 7; FIG. 7B is a view taken along lines 7B of FIGS. 6 and 7; and FIG. 7C is a cross-sectional view taken along the heel along lines 7C in FIGS. 6 and 7;

FIG. 8 is a drawn comparison between a conventional flared sole shoe of the prior art and the contoured sole shoe design according to the invention;

FIG. 9 shows, in FIGS. 9A–9C, the extremely stable conditions for the novel shoe sole according to the invention in its neutral and extreme situations;

FIG. 10 is a side cross-sectional view of the naturally contoured sole side in FIG. 10A showing how the sole maintains constant distance from the ground during rotation of the shoe edge FIG. 11 shows, in FIGS. 11A–11E, a plurality of side sagittal plane cross-sectional views showing examples of conventional sole thickness variations to which the invention can be applied;

FIG. 12 shows, in FIGS. 12A–12D, frontal plane cross-sectional views of the shoe sole according to the invention showing a theoretically ideal stability plane and truncations of the side contour to reduce shoe bulk;

FIG. 13 shows, in FIGS. 13A–13C, the contoured sole design according to the invention when applied to various tread and cleat patterns;

FIG. 18 shows, in FIGS. 18A and 18B, a rear diagrammatic view of a human heel, as relating to a conventional shoe sole (FIG. 18A) and to the sole of the invention (FIG. 18B);

FIG. 19 shows the naturally contoured sides design extended to the other natural contours underneath the load-bearing foot such as the main longitudinal arch;

FIG. 20 illustrates the fully contoured shoe sole design extended to the bottom of the entire non-load-bearing foot;

FIG. 21 shows the fully contoured shoe sole design abbreviated along the sides to only essential structural support and propulsion elements;

FIG. 22 illustrates the application of the invention to provide a street shoe with a correctly contoured sole according to the invention and side edges perpendicular to the ground, as is typical of a street shoe;

FIG. 23 shows a method of establishing the theoretically ideal stability plane using a perpendicular to a tangent method;

FIG. 24 shows a circle radius method of establishing the theoretically ideal stability plane.

FIG. 25 illustrates an alternate embodiment of the invention wherein the sole structure deforms in use to follow a theoretically ideal stability plane according to the invention during deformation;

FIG. 26 shows an embodiment wherein the contour of the sole according to the invention is approximated by a plurality of line segments;

FIG. 27 illustrates an embodiment wherein the stability sides are determined geometrically as a section of a ring.

DETAILED DESCRIPTION OF THE PREFERRED EMBODIMENT

Figure 3:
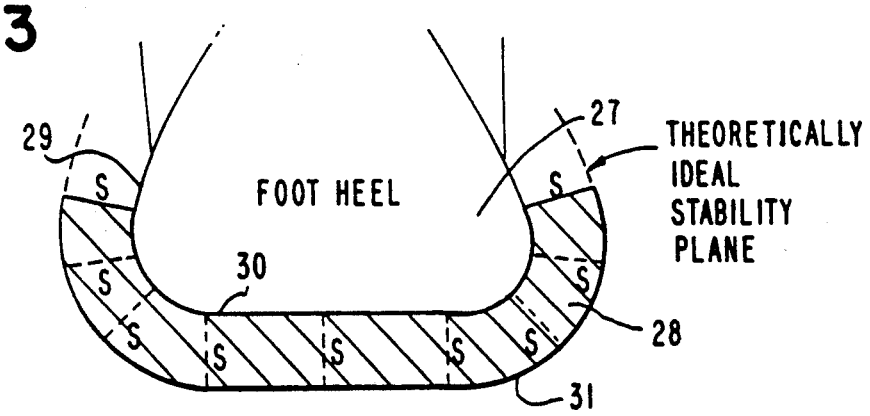
FIG. 3 is a frontal plane cross section showing a shoe sole of uniform thickness that conforms to the natural shape of the human foot, the novel shoe design according to the invention.

A perspective view of an athletic shoe, such as a typical running shoe, according to the prior art, is shown in FIG. 1 wherein a running shoe 20 includes an upper portion 21 and a sole 22. Typically, such a sole includes a truncated outwardly flared construction of the type best seen in FIG. 2 wherein the lower portion **22*a* of the sole heel is significantly wider than the upper portion 22*b* where the sole 22 joins the upper 21**. A number of alternative sole designs are known to the art, including the design shown in U.S. Pat. No. 4,449,306 to Cavanagh wherein an outer portion of the sole of the running shoe includes a rounded portion having a radius of curvature of about 20 mm. The rounded portion lies along approximately the rear-half of the length of the outer side of the mid-sole and heel edge areas wherein the remaining border area is provided with a conventional flaring with the exception of a transition zone. The U.S. Pat. No. 4,557,059 to Misevich, also shows an athletic shoe having a contoured sole bottom in the region of the first foot strike, in a shoe which otherwise uses an inverted flared sole.

In such prior art designs, and especially in athletic and in running shoes, the typical design attempts to achieve stability by flaring the heel as shown in FIGS. 2A and 2B to a width of, for example, 3 to 3½ inches on the bottom outer sole **22*a* of the average male shoe size (10D). On the other hand, the width of the corresponding human heel foot print, housed in the upper 21**, is only about 2.25 in. for the average foot. Therefore, a mismatch occurs in that the heel is locked by the design into a firm shoe heel counter which supports the human heel by holding it tightly and which may also be reenforced by motion control devices to stabilize the heel.

Thus, for natural motion as is shown in FIGS. 2A and 2B, the human heel would normally move in a normal range of motion of approximately 15°, but as shown in FIGS. 2A and 2B the human heel cannot pivot except within the shoe and is resisted by the shoe. Thus, FIG. 2A illustrates the impossibility of pivoting about the center edge of the human heel as would be conventional for barefoot support about a point 23 defined by a line 23*a* perpendicular to the heel and intersecting the bottom edge of upper 21 at a point 24. The lever arm force moment of the flared sole is at a maximum at 0° and only slightly less at a normal 7° inversion or eversion and thus strongly resists such a natural motion as is illustrated in FIGS. 2A and 2B. In FIG. 2A, the outer edge of the heel must compress to accommodate such motion. FIG. 2B illustrates that normal natural motion of the shoe is inefficient in that the center of gravity of the shoe, and the shod foot, is forced upperwardly, as discussed later in connection with FIG. 17.

A narrow rectangular shoe sole design of heel width approximating human heel width is also known and is shown in FIGS. 2C and 2D. It appears to be more efficient than the conventional flared sole shown in FIGS. 2A and 2B. Since the shoe sole width is the same as human sole width, the shoe can pivot naturally with the normal 7° inversion/eversion motion of the running barefoot. In such a design, the lever arm length and the vertical motion of the center of gravity are approximately half that of the flared sole at a normal 7° inversion/eversion running motion. However, the narrow, human heel width rectangular shoe design is extremely unstable and therefore prone to ankle sprain, so that it has not been well received. Thus, neither of these wide or narrow designs is satisfactory.

FIG. 3 shows in a frontal plane cross section at the heel (center of ankle joint) the general concept of the applicant's design: a shoe sole 28 that conforms to the natural shape of the human foot 27 and that has a constant thickness (s) in frontal plane cross sections. The surface 29 of the bottom and sides of the foot 27 should correspond exactly to the upper surface 30 of the shoe sole 28. The shoe sole thickness is defined as the shortest distance (s) between any point on the upper surface 30 of the shoe sole 28 and the lower surface 31 by definition, the surfaces 30 and 31 are consequently parallel (FIGS. 23 and 24 will discuss measurement methods more fully). In effect, the applicant's general concept is a shoe sole 28 that wraps around and conforms to the natural contours of the foot 27 as if the shoe sole 28 were made of a theoretical single flat sheet of shoe sole material of uniform thickness, wrapped around the foot with no distortion or deformation of that sheet as it is bent to the foot's contours. To overcome real world deformation problems associated with such bending or wrapping around contours, actual construction of the shoe sole contours of uniform thickness will preferably involve the use of multiple sheet lamination or injection molding techniques.

Figure 4:
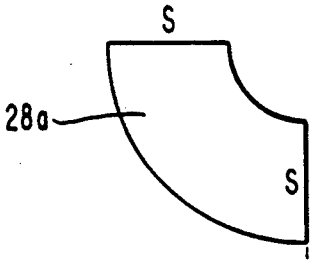
FIG. 4 shows, in FIGS. 4A–4D, a load-bearing flat component of a shoe sole and naturally contoured stability side component, as well as a preferred horizontal periphery of the flat load-bearing portion of the shoe sole when using the sole of the invention.
Figure 4A:
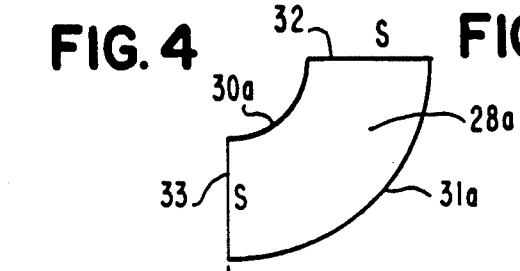
Figure 4B:
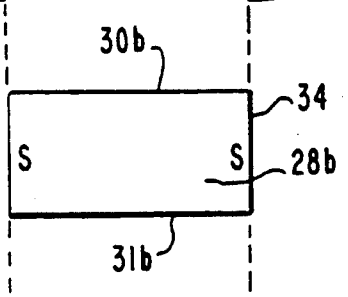
Figure 4C:
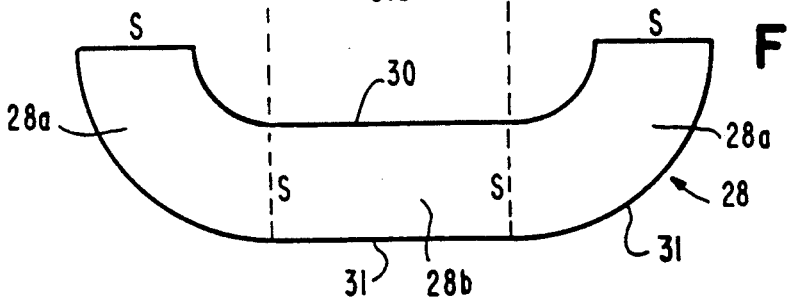
Figure 4D:
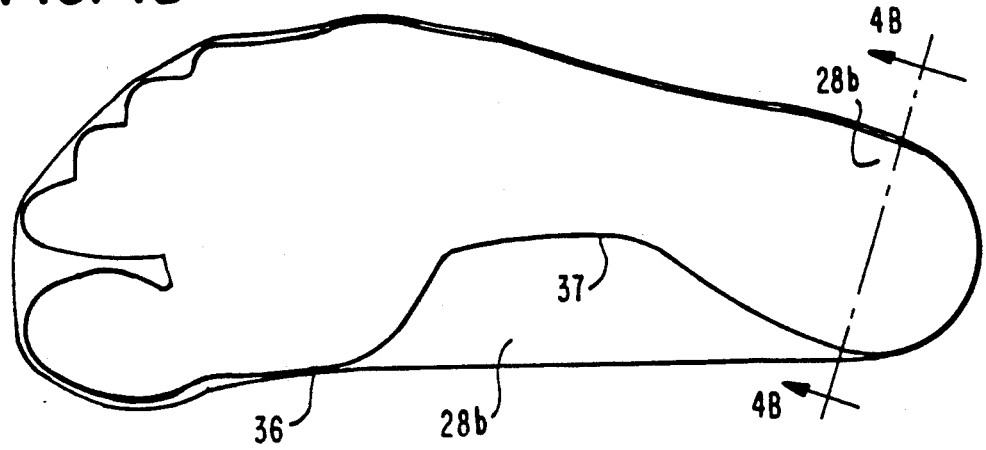

FIGS. 4A, 4B, and 4C illustrate in frontal plane cross section a significant element of the applicant's shoe design in its use of naturally contoured stabilizing sides 28*a* at the outer edge of a shoe sole 28*b* illustrated generally at the reference numeral 28. It is thus a main feature of the applicant's invention to eliminate the unnatural sharp bottom edge, especially of flared shoes, in favor of a naturally contoured shoe sole outside 31 as shown in FIG. 3. The side or inner edge 30*a* of the shoe sole stability side 28*a* is contoured like the natural form on the side or edge of the human foot, as is the outside or outer edge 31*a* of the shoe sole stability side 28*a* to follow a theoretically ideal stability plane. According to the invention, the thickness (s) of the shoe sole 28 is maintained exactly constant, even if the shoe sole is tilted to either side, or forward or backward. Thus, the naturally contoured stabilizing sides 28*a*, according to the applicant's invention, are defined as the same as the thickness 33 of the shoe sole 28 so that, in cross section, the shoe sole comprises a stable shoe sole 28 having at its outer edge naturally contoured stabilizing sides 28*a* with a surface 31*a* representing a portion of a theoretically ideal stability plane and described by naturally contoured sides equal to the thickness (s) of the sole 28. The top of the shoe sole 30*b* coincides with the shoe wearer's load-bearing footprint, since in the case shown the shape of the foot is assumed to be load-bearing and therefore flat along the bottom. A top edge 32 of the naturally contoured stability side 28*a* can be located at any point along the contoured side 29 of the foot, while the inner edge 33 of the naturally contoured side 28*a* coincides with the perpendicular sides 34 of the load-bearing shoe sole 28*b*. In practice, the shoe sole 28 is preferably integrally formed from the portions 28*b* and 28*a*. Thus, the theoretically ideal stability plane includes the contours 31*a* merging into the lower surface 31*b* of the sole 28. Preferably, the peripheral extent 36 of the load-bearing portion of the sole 28*b* of the shoe includes all of the support structures of the foot but extends no further than the outer edge of the foot sole 37 as defined by a load-bearing footprint, as shown in FIG. 4D, which is a top view of the upper shoe sole surface 30*b*. FIG. 4D thus illustrates a foot outline at numeral 37 and a recommended sole outline 36 relative thereto. Thus, a horizontal plane outline of the top of the load-bearing portion of the shoe sole, therefore exclusive of contoured stability sides, should, preferably, coincide as nearly as practicable with the load-bearing portion of the foot sole with which it comes into contact. Such a horizontal outline, as best seen in FIGS. 4D and 7D, should remain uniform throughout the entire thickness of the shoe sole eliminating negative or positive sole flare so that the sides are exactly perpendicular to the horizontal plane as shown in FIG. 4B. Preferably, the density of the shoe sole material is uniform.

Another significant feature of the applicant's invention is illustrated diagrammatically in FIG. 5. Preferably, as the heel lift or wedge 38 of thickness (s1) increases the total thickness (s+s1) of the combined midsole and outersole 39 of thickness (s) in an aft direction of the shoe, the naturally contoured sides 28*a* increase in thickness exactly the same amount according to the principles discussed in connection with FIG. 4. Thus, according to the applicant's design, the thickness of the inner edge 33 of the naturally contoured side is always equal to the constant thickness (s) of the load-bearing shoe sole 28*b* in the frontal cross-sectional plane.

As shown in FIG. 5B, for a shoe that follows a more conventional horizontal plane outline, the sole can be improved significantly according to the applicant's invention by the addition of a naturally contoured side 28*a* which correspondingly varies with the thickness of the shoe sole and changes in the frontal plane according to the shoe heel lift 38. Thus, as illustrated in FIG. 5B, the thickness of the naturally contoured side 28*a* in the heel section is equal to the thickness (s+s1) of the shoe sole 28 which is thicker than the shoe sole 39 thickness (s) shown in FIG. 5A by an amount equivalent to the heel lift 38 thickness (s1). In the generalized case, the thickness (s) of the contoured side is thus always equal to the thickness (s) of the shoe sole.

FIG. 6 illustrates a side cross-sectional view of a shoe to which the invention has been applied and is also shown in a top plane view in FIG. 7. Thus, FIGS. 7A, 7B and 7C represent frontal plane cross-sections taken along the forefoot, at the base of the fifth metatarsal, and at the heel, thus illustrating that the shoe sole thickness is constant at each frontal plane cross-section, even though that thickness varies from front to back, due to the heel lift 38 as shown in FIG. 6, and that the thickness of the naturally contoured sides is equal to the shoe sole thickness in each FIG. 7A–7C cross section. Moreover, in FIG. 7D, a horizontal plane overview of the left foot, it can be seen that the contour of the sole follows the preferred principle in matching, as nearly as practical, the load-bearing sole print shown in FIG. 4D.

FIG. 8 thus contrasts in frontal plane cross section the conventional flared sole 22 shown in phantom outline and illustrated in FIG. 2 with the contoured shoe sole 28 according to the invention as shown in FIGS. 3–7.

FIG. 9 is suitable for analyzing the shoe sole design according to the applicant's invention by contrasting the neutral situation shown in FIG. 9A with the extreme tilting situations shown in FIGS. 9B and 9C. Unlike the sharp sole edge of a conventional shoe as shown in FIG. 2, the effect of the applicant's invention having a naturally contoured side 28*a* is totally neutral allowing the shod foot to react naturally with the ground 43, in either an inversion or eversion mode. This occurs in part because of the unvarying thickness along the shoe sole edge which keeps the foot sole equidistant from the ground in a preferred case. Moreover, because the shape of the edge 31*a* of the shoe contoured side 28*a* is exactly like that of the edge of the foot, the shoe is enabled to react naturally with the ground in a manner as closely as possible simulating the foot. Thus, in the neutral position shown in FIG. 9, any point 40 on the surface of the shoe sole 30*b* closest to ground lies at a distance (s) from the ground surface 43. That distance (s) remains constant even for extreme situations as seen in FIGS. 9B and 9C.

A main point of the applicant's invention, as is illustrated in FIGS. 9B and 9C, is that the design shown is stable in an in extremis situation. The ideal plane of stability where the stability is plane is defined as sole thickness which is constant under all load-bearing points of the foot sole for any amount from 0° to 90° rotation of the sole to either side or front and back. In other words, as shown in FIG. 9, if the shoe is tilted from 0° to 90° to either side or from 0° to 90° forward or backward representing a 0° to 90° foot dorsiflexion or 0° to 90° plantarflexion, the foot will remain stable because the sole thickness (s) between the foot and the ground always remain constant because of the exactly contoured sides. By remaining a constant distance from the ground, the stable shoe allows the foot to react to the ground as if the foot were bare while allowing the foot to be protected and cushioned by the shoe. In its preferred embodiment, the new naturally contoured sides will effectively position and hold the foot onto the load-bearing foot print section of the shoe sole, reducing the need for heel counters and other motion control devices.

FIG. 10A illustrates how the inner edge 30*a* of the naturally contoured sole side 28*a* is maintained at a constant distance (s) from the ground through various degrees of rotation of the edge 31*a* of the shoe sole such as is shown in FIG. 9. FIG. 10B shows how a conventional shoe sole pivots around its lower edge 42, which is its center of rotation, instead of around the upper edge 40, which, as a result, is not maintained at constant distance (s) from the ground, as with the invention, but is lowered to 0.7(s) at 45° rotation and to zero at 90° rotation.

FIG. 11 shows typical conventional sagittal plane shoe sole thickness variations, such as heel lifts or wedges 38, or toe taper 38*a*, or full sole taper 38*b*, in FIGS. 11A–11E and how the naturally contoured sides 28*a* equal and therefore vary with those varying thicknesses as discussed in connection with FIG. 5.

FIG. 12 illustrates an embodiment of the invention which utilizes varying portions of the theoretically ideal stability plane 51 in the naturally contoured sides 28*a* in order to reduce the weight and bulk of the sole, while accepting a sacrifice in some stability of the shoe. Thus, FIG. 12A illustrates the preferred embodiment as described above in connection with FIG. 5 wherein the outer edge 31*a* of the naturally contoured sides 28*a* follows a theoretically ideal stability plane 51. As in FIGS. 3 and 4, the contoured surfaces 31*a*, and the lower surface of the sole 31*b* lie along the theoretically ideal stability plane 51. The theoretically ideal stability plane 51 is defined as the plane of the surface of the bottom of the shoe sole 31, wherein the shoe sole conforms to the natural shape of the wearer's foot sole, particularly the sides, and has a constant thickness in frontal plane cross sections. As shown in FIG. 12B, an engineering trade off results in an abbreviation within the theoretically ideal stability plane 51 by forming a naturally contoured side surface 53*a* approximating the natural contour of the foot (or more geometrically regular, which is less preferred) at an angle relative to the upper plane of the shoe sole 28 so that only a smaller portion of the contoured side 28*a* defined by the constant thickness lying along the surface 31*a* is coplanar with the theoretically ideal stability plane 51. FIGS. 12C and 12D show similar embodiments wherein each engineering trade-off shown results in progressively smaller portions of contoured side 28*a*, which lies along the theoretically ideal stability plane 51. The portion of the surface 31*a* merges into the upper side surface 53*a* of the naturally contoured side.

The embodiment of FIG. 12 may be desirable for portions of the shoe sole which are less frequently used so that the additional part of the side is used less frequently. For example, a shoe may typically roll out laterally, in an inversion mode, to about 20° on the order of 100 times for each single time it rolls out to 40°. For a basketball shoe, shown in FIG. 12B, the extra stability is needed. Yet, the added shoe weight to cover that infrequently experienced range of motion is about equivalent to covering the frequently encountered range. Since, in a racing shoe this weight might not be desirable, an engineering trade-off of the type shown in FIG. 12D is possible. A typical running/jogging shoe is shown in FIG. 12C. The range of possible variations is limitless, but includes at least the maximum of 90 degrees in inversion or eversion, as shown in FIG. 12A.

FIG. 13 shows the theoretically ideal stability plane 51 in defining embodiments of the shoe sole having differing tread or cleat patterns. Thus, FIG. 13 illustrates that the invention is applicable to shoe soles having conventional bottom treads. Accordingly, FIG.

13A is similar to FIG. 12B further including a tread portion 60, while FIG. 13B is also similar to FIG. 12B wherein the sole includes a cleated portion 61. The surface 63 to which the cleat bases are affixed should preferably be on the same plane and parallel the theoretically ideal stability plane 51, since in soft ground that surface rather than the cleats become load-bearing. The embodiment in FIG. 13C is similar to FIG. 12C showing still an alternative tread construction 62. In each case, the load-bearing outer surface of the tread or cleat pattern 60-62 lies along the theoretically ideal stability plane 51.

Figure 14:
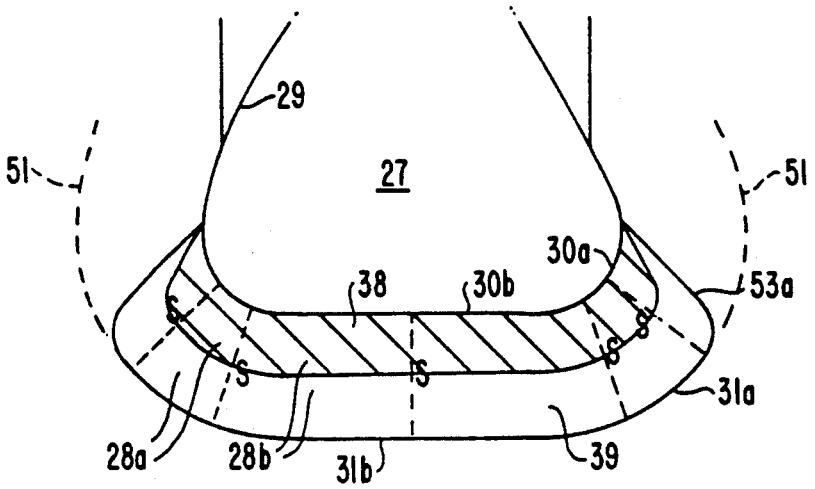
FIG. 14 illustrates, in a rear view, an application of the sole according to the invention to a shoe to provide an aesthetically pleasing and functionally effective design.

FIG. 14 shows, in a rear cross sectional view, the application of the invention to a shoe to produce an aesthetically pleasing and functionally effective design. Thus, a practical design of a shoe incorporating the invention is feasible, even when applied to shoes incorporating heel lifts 38 and a combined midsole and outersole 39. Thus, use of a sole surface and sole outer contour which track the theoretically ideal stability plane does not detract from the commercial appeal of shoes incorporating the invention.

Figure 15:
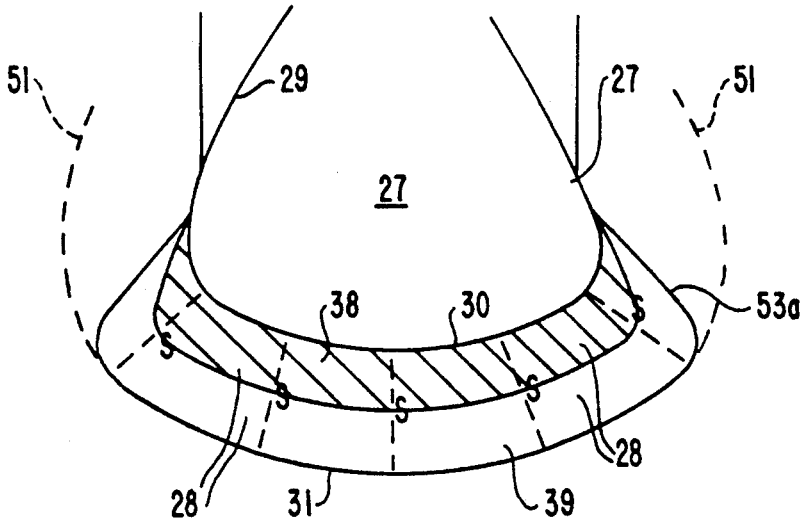
FIG. 15 shows a fully contoured shoe sole design that follows the natural contour of the bottom of the foot as well as the sides.

FIG. 15 shows a fully contoured shoe sole design that follows the natural contour of all of the foot, the bottom as well as the sides. The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 15 would deform by flattening to look essentially like FIG. 14. Seen in this light, the naturally contoured side design in FIG. 14 is a more conventional, conservative design that is a special case of the more general fully contoured design in FIG. 15, which is the closest to the natural form of the foot, but the least conventional. The amount of deformation flattening used in the FIG. 14 design, which obviously varies under different loads, is not an essential element of the applicant's invention.

FIGS. 14 and 15 both show in frontal plane cross section the essential concept underlying this invention, the theoretically ideal stability plane, which is also theoretically ideal for efficient natural motion of all kinds, including running, Jogging or walking. FIG. 15 shows the most general case of the invention,. the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29, to which the theoretically ideal stability plane 31 is by definition parallel.

For the special case shown in FIG. 14, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole, as shown in FIG. 4.

The theoretically ideal stability plane for the special case is composed conceptually of two parts . Shown in FIGS. 14 and 4 the first part is a line segment 31*b* of equal length and parallel to 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (S) from the closest point on the contoured side inner edge 30*a;* consequently, the inner and outer contoured edges 31A and 30A are by definition parallel.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described. It can be stated unequivocally that any shoe sole contour, even of similar contour, that exceeds the theoretically ideal stability plane will restrict natural foot motion, while any less than that plane will degrade natural stability, in direct proportion to the amount of the deviation.

Figure 16:
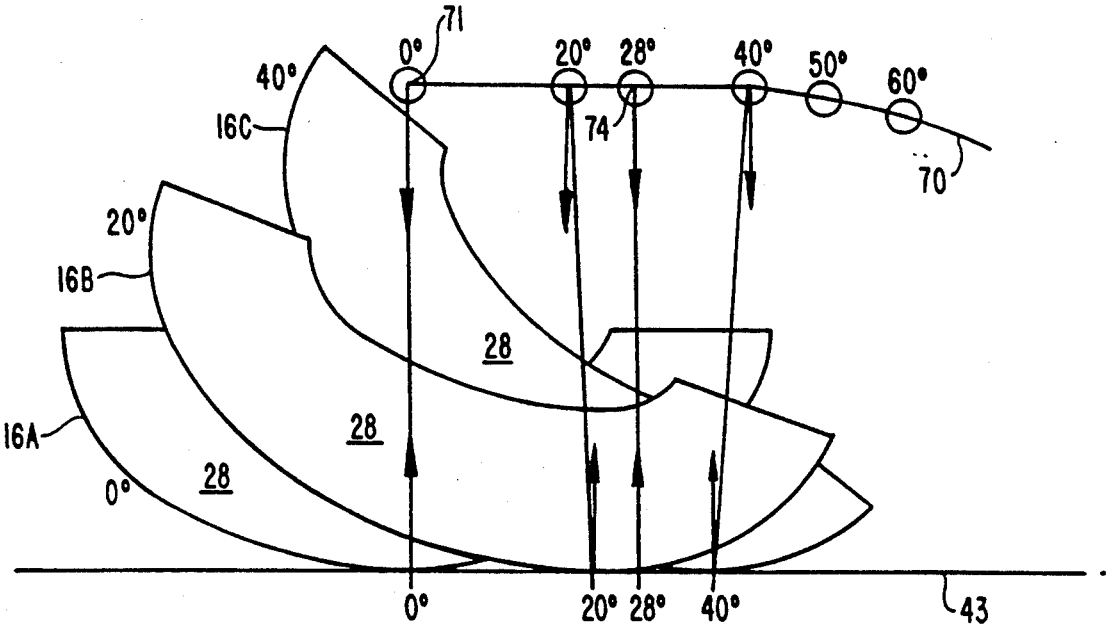
FIG. 16 is a diagrammatic frontal plane cross-sectional view of static forces acting on the ankle joint and its position relative to the shoe sole according to the invention during normal and extreme inversion and eversion motion.

FIG. 16 illustrates in a curve 70 the range of side to side inversion/eversion motion of the ankle center of gravity 71 from the shoe according to the invention shown in frontal plane cross section at the ankle. Thus, in a static case where the center of gravity 71 lies at approximately the mid-point of the sole, and assuming that the shoe inverts or everts from 0° to 20° to 40 °, as shown in progress ions 16A, 16B and 16C, the locus of points of motion for the center of gravity thus defines the curve 70 wherein the center of gravity 71 maintains a steady level motion with no vertical component through 40° of inversion or eversion. For the embodiment shown, the shoe sole stability equilibrium point is at 28° (at point 74) and in no case is there a pivoting edge to define a rotation point as in the case of FIG. 2. The inherently superior side to side stability of the design provides pronation control (or eversion), as well as lateral (or inversion) control. In marked contrast to conventional shoe sole designs, the applicant's shoe design creates virtually no abnormal torque to resist natural inversion/eversion motion or to destabilize the ankle joint.

Figure 17:
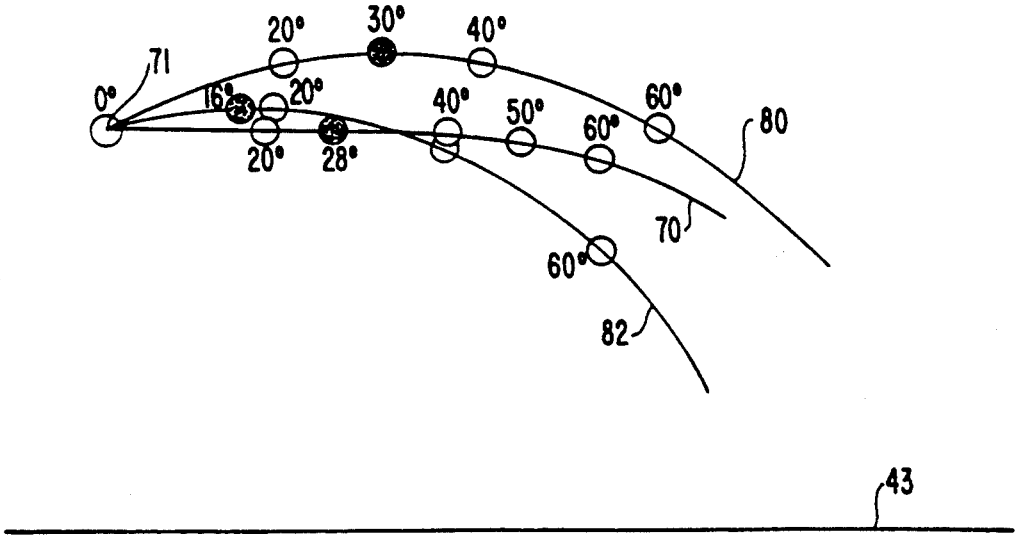
FIG. 17 is a diagrammatic frontal plane view of a plurality of moment curves of the center of gravity for various degrees of inversion for the shoe sole according to the invention, and contrasted to the motions shown in FIG. 2.

FIG. 17 thus compares the range of motion of the center of gravity for the invention, as shown in curve 70, in comparison to curve 80 for the conventional wide heel flare and a curve 82 for a narrow rectangle the width of a human heel. Since the shoe stability limit is 28° in the inverted mode, the shoe sole is stable at the 20° approximate barefoot inversion limit. That factor, and the broad base of support rather than the sharp bottom edge of the prior art, make the contour design stable even in the most extreme case as shown in FIGS. 16*a*-16*c* and permit the inherent stability of the barefoot to dominate without interference, unlike existing designs, by providing constant, unvarying shoe sole thickness in frontal plane cross sections. The stability superiority of the contour side design is thus clear when observing how much flatter its center of gravity curve 70 is than in existing popular wide flare design 80. The curve demonstrates that the contour side design has significantly more efficient natural 7° inversion/eversion motion than the narrow rectangle design the width of a human heel, and very much more efficient than the conventional wide flare design; at the same time, the contour side design is more stable in extremis than either conventional design because of the absence of destabilizing torque.

FIG. 18A illustrates, in a pictorial fashion, a comparison of a cross section at the ankle joint of a conventional shoe with a cross section of a shoe according to the invention when engaging a heel. As seen in FIG. 18A, when the heel of the foot 27 of the wearer engages an upper surface of the shoe sole 22, the shape of, the foot heel and the shoe sole is such that the conventional shoe sole 22 conforms to the contour of the ground 43 and not to the contour of the sides of the foot 27. As a result, the conventional shoe sole 22 cannot follow the natural 7° inversion/eversion motion of the foot, and that normal motion is resisted by the shoe upper 21, especially when strongly reinforced by firm heel counters and motion control devices. This interference with natural motion represents the fundamental misconception of the currently available designs. That misconception on which existing shoe designs are based is that, while shoe uppers are considered as a part of the foot and conform to the shape of the foot, the shoe sole is functionally conceived of as a part of the ground and is therefore shaped flat like the ground, rather than contoured like the foot.

In contrast, the new design, as illustrated in FIG. 18B, illustrates a correct conception of the shoe sole 28 as a part of the foot and an extension of the foot, with shoe sole sides contoured exactly like those of the foot, and with the frontal plane thickness of the shoe sole between the foot and the ground always the same and therefore completely neutral to the natural motion of the foot. With the correct basic conception, as described in connection with this invention, the shoe can move naturally with the foot, instead of restraining it, so both natural stability and natural efficient motion coexist in the same shoe, with no inherent contradiction in design goals.

Thus, the contoured shoe design of the invention brings together in one shoe design the cushioning and protection typical of modern shoes, with the freedom from injury and functional efficiency, meaning speed, and/or endurance, typical of barefoot stability and natural freedom of motion. Significant speed and endurance improvements are anticipated, based on both improved efficiency and on the ability of a user to train harder without injury.

These figures also illustrate that the shoe heel cannot pivot ±7 degrees with the prior art shoe of FIG. 18A. In contrast, the shoe heel in the embodiment of FIG. 18B pivots with the natural motion of the foot heel.

FIGS. 19A–D illustrate, in frontal plane cross sections, the naturally contoured sides design extended to the other natural contours underneath the load-bearing foot, such as the main longitudinal arch, the metatarsal (or forefoot) arch, and the ridge between the heads of the metatarsals (forefoot) and the heads of the distal phalanges (toes). As shown, the shoe sole thickness remains constant as the contour of the shoe sole follows that of the sides and bottom of the load-bearing foot. FIG. 19E shows a sagittal plane cross section of the shoe sole conforming to the contour of the bottom of the load-bearing foot, with thickness varying according to the heel lift 38. FIG. 19F shows a horizontal plane top view of the left foot that shows the areas 85 of the shoe sole that correspond to the flattened portions of the foot sole that are in contact with the ground when load-bearing. Contour lines 86 and 87 show approximately the relative height of the shoe sole contours above the flattened load-bearing areas 85 but within roughly the peripheral extent 35 of the upper surface of sole 30 shown in FIG. 4. A horizontal plane bottom view (not shown) of FIG. 19F would be the exact reciprocal or converse of FIG. 19F (i.e. peaks and valleys contours would be exactly reversed).

FIGS. 20A–D show, in frontal plane cross sections, the fully contoured shoe sole design extended to the bottom of the entire non-load-bearing foot. FIG. 20E shows a sagittal plane cross section. The shoe sole contours underneath the foot are the same as FIGS. 19A–E except that there are no flattened areas corresponding to the flattened areas of the load-bearing foot. The exclusively rounded contours of the shoe sole follow those of the unloaded foot. A heel lift 38, the same as that of FIG. 19, is incorporated in this embodiment, but is not shown in FIG. 20.

FIG. 21 shows the horizontal plane top view of the left foot corresponding to the fully contoured design described in FIGS. 20A–E, but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95, the heads of the metatarsals 96, and the base of the fifth metatarsal 97. They must be supported both underneath and to the outside for stability. The essential propulsion element is the head of first distal phalange 98. The medial (inside) and lateral (outside) sides supporting the base of the calcaneus are shown in FIG. 21 oriented roughly along either side of the horizontal plane subtalar ankle joint axis, but can be located also more conventionally along the longitudinal axis of the shoe sole. FIG. 21 shows that the naturally contoured stability sides need not be used except in the identified essential areas. Weight savings and flexibility improvements can be made by omitting the non-essential stability sides. Contour lines 86 through 89 show approximately the relative height of the shoe sole contours within roughly the peripheral extent 35 of the undeformed upper surface of shoe sole 30 shown in FIG. 4. A horizontal plane bottom view (not shown) of FIG. 21 would be the exact reciprocal or converse of FIG. 21 (i.e. peaks and valleys contours would be exactly reversed).

FIG. 22A shows a development of street shoes with naturally contoured sole sides incorporating the features of the invention. FIG. 22A develops a theoretically ideal stability plane 51, as described above, for such a street shoe, wherein the thickness of the naturally contoured sides equals the shoe sole thickness. The resulting street shoe with a correctly contoured sole is thus shown in frontal plane heel cross section in FIG. 22A, with side edges perpendicular to the ground, as is typical. FIG. 22B shows a similar street shoe with a fully contoured design, including the bottom of the sole. Accordingly, the invention can be applied to an unconventional heel lift shoe, like a simple wedge, or to the most conventional design of a typical walking shoe with its heel separated from the forefoot by a hollow under the instep. The invention can be applied just at the shoe heel or to the entire shoe sole. With the invention, as so applied, the stability and natural motion of any existing shoe design, except high heels or spike heels, can be significantly improved by the naturally contoured shoe sole design.

FIG. 23 shows a method of measuring shoe sole thickness to be used to construct the theoretically ideal stability plane of the naturally contoured side design. The constant shoe sole thickness of this design is measured at any point on the contoured sides along a line that, first, is perpendicular to a line tangent to that point on the surface of the naturally contoured side of the foot sole and, second, that passes through the same foot sole surface point.

FIG. 24 illustrates another approach to constructing the theoretically ideal stability plane, and one that is easier to use, the circle radius method. By that method, the pivot point (circle center) of a compass is placed at the beginning of the foot sole's natural side contour (frontal plane cross section) and roughly a 90° arc (or much less, if estimated accurately) of a circle of radius equal to (s) or shoe sole thickness is drawn describing the area farthest away from the foot sole contour. That process is repeated all along the foot sole's natural side contour at very small intervals (the smaller, the more accurate). When all the circle sections are drawn, the outer edge farthest from the foot sole contour (again, frontal plane cross section) is established at a distance of "s" and that outer edge coincides with the theoretically ideal stability plane. Both this method and that described in FIG. 23 would be used for both manual and CADCAM design applications.

The shoe sole according to the invention can be made by approximating the contours, as indicated in FIGS. 25A, 25B, and 26. FIG. 25A shows a frontal plane cross section of a design wherein the sole material in areas 107 is so relatively soft that it deforms easily to the contour of shoe sole 28 of the proposed invention. In the proposed approximation as seen in FIG. 25B, the heel cross section includes a sole upper surface 101 and a bottom sole edge surface 102 following when deformed an inset theoretically ideal stability plane 51. The sole edge surface 102 terminates in a laterally extending portion 103 joined to the heel of the sole 28. The laterally-extending portion 103 is made from a flexible material and structured to cause its lower surface 102 to terminate during deformation to parallel the inset theoretically ideal stability plane 51. Sole material in specific areas 107 is extremely soft to allow sufficient deformation. Thus, in a dynamic case, the outer edge contour assumes approximately the theoretically ideal stability shape described above as a result of the deformation of the portion 103. The top surface 101 similarly deforms to approximately parallel the natural contour of the foot as described by lines **30*a* and 30*b*** shown in FIG. 4.

It is presently contemplated that the controlled or programmed deformation can be provided by either of two techniques. In one, the shoe sole sides, at especially the midsole, can be cut in a tapered fashion or grooved so that the bottom sole bends inwardly under pressure to the correct contour. The second uses an easily deformable material 107 in a tapered manner on the sides to deform under pressure to the correct contour. While such techniques produce stability and natural motion results which are a significant improvement over conventional designs, they are inherently inferior to contours produced by simple geometric shaping. First, the actual deformation must be produced by pressure which is unnatural and does not occur with a bare foot and second, only approximations are possible by deformation, even with sophisticated design and manufacturing techniques, given an individual's particular running gait or body weight. Thus, the deformation process is limited to a minor effort to correct the contours from surfaces approximating the ideal curve in the first instance.

The theoretically ideal stability plane can also be approximated by a plurality of line segments 110, such as tangents, chords, or other lines as shown in FIG. 26. Both the upper surface of the shoe sole 28, which coincides with the side of the foot **30*a*, and the bottom surface 31*a* of the naturally contoured side can be approximated. While a single flat plane 110 approximation may correct many of the biomechanical problems occurring with existing designs, because it can provide a gross approximation of the both natural contour of the foot and the theoretically ideal stability plane 51**, the single plane approximation is presently not preferred, since it is the least optimal. By increasing the number of flat planar surfaces formed, the curve more closely approximates the ideal exact design contours, as previously described. Single and double plane approximations are shown as line segments in the cross section illustrated in FIG. 26.

FIG. 27 shows a frontal plane cross section of an alternate embodiment for the invention showing stability sides component **28*a* that are determined in a mathematically precise manner to conform approximately to the sides of the foot. (The center or load-bearing shoe sole component 28*b* would be as described in FIG. 4). The component sides 28*a* would be a quadrant of a circle of radius (r+r1), where distance (r) must equal sole thickness (s); consequently the sub-quadrant of radius ($r^1$) is removed from quadrant ($r+r^1$). In geometric terms, the component side 28*a* is thus a quarter or other section of a ring. The center of rotation 115 of the quadrants is selected to achieve a sole upper side surface 30*a*** that closely approximates the natural contour of the side of the human foot.

FIG. 27 provides a direct bridge to another invention by the applicant, a shoe sole design with quadrant stability sides.

FIG. 28 shows a shoe sole design that allows for unobstructed natural inversion/eversion motion of the calcaneus by providing maximum shoe sole flexibility particularly between the base of the calcaneus 125 (heel) and the metatarsal heads 126 (forefoot) along an axis 120. An unnatural torsion occurs about that axis if flexibility is insufficient so that a conventional shoe sole interferes with the inversion/eversion motion by restraining it. The object of the design is to allow the relatively more mobile (in eversion and inversion) calcaneus to articulate freely and independently from the relatively more fixed forefoot, instead of the fixed or fused structure or lack of stable structure between the two in conventional designs. In a sense, freely articulating joints are created in the shoe sole that parallel those of the foot. The design is to remove nearly all of the shoe sole material between the heel and the forefoot, except under one of the previously described essential structural support elements, the base of the fifth metatarsal 97. An optional support for the main longitudinal arch 121 may also be retained for runners with substantial foot pronation, although would not be necessary for many runners. The forefoot can be subdivided (not shown) into its component essential structural support and propulsion elements, the individual heads of the metatarsal and the heads of the distal phalanges, so that each major articulating joint set of the foot is paralleled by a freely articulating shoe sole support propulsion element, an anthropomorphic design; various aggregations of the subdivisions are also possible. An added benefit of the design is to provide better flexibility along axis 122 for the forefoot during the toe-off propulsive phase of the running stride, even in the absence of any other embodiments of the applicant's invention; that is, the benefit exists for conventional shoe sole designs.

Figure 28C:
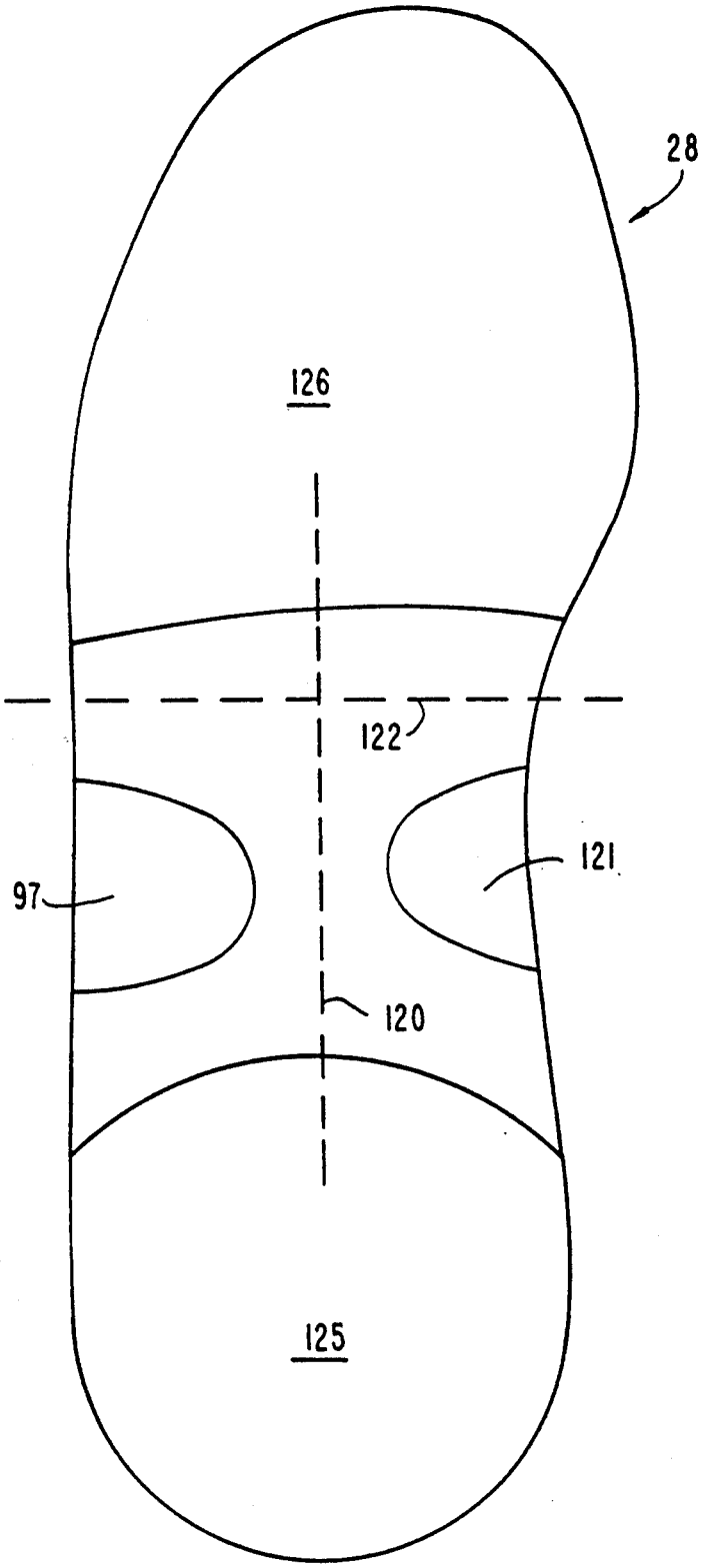
FIG. 28 shows a shoe sole design that allows for unobstructed natural eversion/inversion motion by providing torsional flexibility in the instep area of the shoe sole.

FIG. 28A shows in sagittal plane cross section a specific design maximizing flexibility, with large non-essential sections removed for flexibility and connected by only a top layer (horizontal plane) of non-stretching fabric 123 like Dacron polyester or Kevlar. FIG. 28B shows another specific design with a thin top sole layer 124 instead of fabric and a different structure for the flexibility sections: a design variation that provides greater structural support, but less flexibility, though still much more than conventional designs. Not shown is a simple, minimalist approach, which is comprised of single frontal plane slits in the shoe sole material (all layers or part): the first midway between the base of the calcaneus and the base of the fifth metatarsal, and the second midway between that base and the metatarsal heads. FIG. 28C shows a bottom view (horizontal plane) of the inversion/eversion flexibility design.

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A shoe sole construction for a shoe, comprising:

a shoe sole having a flat sole portion including an upper, foot sole-contacting surface;

the shoe sole also having at least one contoured side portion merging with the flat sole portion and the contoured side portion having an upper, foot sole-contacting surface conforming to the curved shape of at least a part of one side of the foot sole of a wearer;

and the shoe sole having a uniform thickness, when measured in frontal plane cross sections, in all direct load-bearing parts of the shoe sole;

the direct load-bearing parts of the shoe sole includes both that part of the sole portion and that part of the contoured side portion which become directly load-bearing when the shoe sole on the ground is tilted sideways, away from an upright position;

the uniform thickness of the shoe sole extends through at least a contoured side portion providing direct structural support between foot sole and ground through a sideways tilt of at least 20 degrees;

said shoe sole thickness being defined as the shortest distance between any point on an upper, foot sole-contacting surface of said shoe sole and a lower, ground-contacting surface of said shoe sole, when measured in frontal plane cross sections;

said flat sole portion having a varying thickness when measured in sagittal plane cross sections, said thickness being greater in the heel area than in the forefoot area;

said thickness of the contoured side portion equaling and therefore varying directly with the thickness of the flat sole portion to which it is merged, when the thickness is measured in the frontal plane cross sections;

the uniform thickness of the shoe sole is different in at least two frontal plane cross sections wherein the shoe sole has a contoured side portion of at least 20 degrees, so that there are at least two different contoured side portion thicknesses, when measured in frontal plane cross sections;

whereby the constant thickness in frontal plane cross sections, including the side portion, maintains foot stability like when bare, especially during pronation and supination motion.

2. The sole construction as set forth in claim 1, wherein said contoured side portion merges with at least a heel portion of said sole portion.

3. The sole construction as set forth in claim 2, wherein said contoured side portion merges with at least a lateral heel portion of said sole portion.

4. The sole construction as set forth in claim 1, wherein said contoured side portion merges with at least a sole portion under the base of the fifth metatarsal.

5. The sole construction as set forth in claim 3, wherein said contoured side portion extends along only selected portions of the periphery of said shoe sole portion.

6. The sole construction as set forth in claim 3, wherein said contoured side portion merges with at least a lateral and medial heel portion of said sole portion.

7. The sole construction as set forth in claim 3, wherein the lower ground-contacting surface of the shoe sole is connected to the upper foot-contacting surface by a contoured side surface.

8. The sole construction as set forth in claim 3, wherein at least a part of said contoured side portion is determined in frontal plane cross sections by using a section of a ring with a thickness equaling the shoe sole thickness to approximate the contour of the side of the foot sole of a wearer and maintain exactly the thickness of the shoe sole portion.

9. The sole construction as set forth in claim 2, wherein said contoured side portion merges with at least a medial heel portion of said sole position.

10. The sole construction as set forth in claim 1, wherein the side portion extends entirely around the horizontal contour of the sole portion at an edge thereof.

11. The shoe sole construction as set forth in claim 3, wherein at least a portion of non-essential shoe sole sections are removed for flexibility and connected by a top layer of flexible and inelastic material.

12. The shoe sole construction as set forth in claim 3, wherein said shoe sole includes at least one frontal plane slit for flexibility.

13. The shoe sole construction as set forth in claim 3, wherein at least one frontal plane slit is located midway between the base of the calcaneus and the base of the fifth metatarsal, and another midway between that base and the metatarsal heads.

14. The shoe sole construction as set forth in claim 3, wherein said contoured side portion is located only at a plurality of support and propulsion elements, including the base and lateral tuberosity of the calcaneus, the head of the first and fifth metatarsals, the base of the fifth metatarsal, and the head of the first distal phalange to provide said shoe sole with flexibility paralleling the foot sole flexibility of a wearer;

whereby said shoe sole maintaining the inherent stability and, uninterrupted motion of said foot throughout sideways pronation and supination motion.

15. The shoe sole construction as set forth in claim 14, wherein the density of the retained shoe sole side portions is greater than the density of the material used in said shoe flat sole portion, in order to compensate for increased pressure loading during inversion and eversion motion of said foot.

16. The shoe sole construction as set forth in claim 14, wherein said contoured side portion is only retained at all said support and propulsion elements.

17. The sole construction as set forth in claim 3, wherein the amount of any shoe sole side portions of said uniform thickness is determined by the degree of shoe sole stability desired and the shoe sole weight and bulk required to provide said stability;

the amount of said coplanar contoured sides that is provided said shoe sole being sufficient to maintain the stability of the wearer's foot throughout the range of foot inversion and eversion motion for which said shoe is intended;

said range including any wearer's foot inversion and eversion motion up to a maximum of 90 degrees.

18. The sole construction as set forth in claim 3, wherein the amount of any shoe sole contoured side that is provided said shoe sole is sufficient to maintain lateral stability of the wearer's foot throughout its full range of sideways motion, including at least 7 degrees of pronation and at least 7 degrees of supination, as measured at the heel; said lateral stability being like that of the wearer's foot when bare.

19. The shoe sole construction as set forth in claim 3, wherein said ground-contacting portion of said shoe portion includes bottom treads including a plurality of cleats, an outermost surface of said bottom treads lying along the ground contacting surface of said shoe sole.

20. The shoe sole construction as set forth in claim 3, wherein said shoe sole is a street shoe sole having the lower ground-contacting surface of the shoe sole connected to the upper foot-contacting surface by a planar side surface that is vertically-oriented.

21. The shoe sole construction as set forth in claim 20, wherein said street shoe sole has a hollow instep area,

22. The shoe sole construction as set forth in claim 3, wherein a load-bearing outer surface of the sole sole is constructed in frontal plane cross sections by the circle radius method using the surface contour of a wearer's foot sole as a locus of centers of the radii and radii equal to the thickness of the flat sole portion to construct a composite outer, ground-contacting surface of the shoe sole.

23. The shoe sole construction as set forth in claim 3, wherein at least part of the upper surface of said flat sole portion conforms to the contours of the sole of the load-bearing foot of the wearer.

24. The shoe sole construction as set forth in claim 3, wherein said shoe sole is made of material of such composition as to allow a structural deformation of the shoe sole following a structural deformation of the wearer's foot sole, thus allowing the shoe sole to deform by flattening under a wearer's body weight load like the wearer's foot sole does under the same load, so that the shoe sole conforms to the shape of the wearer's foot sole when under a body weight load;

whereby said shoe sole structure maintains intact the firm lateral stability of the wearer's foot, as demonstrated when said foot is unshod and tilted out laterally in inversion to the extreme 20 degree limit of the range of motion of the ankle joint of the wearer's foot.

25. The shoe sole construction as set forth in claim 3, wherein at least a portion of the upper surface of said flat sole portion conforms to the contour of the bottom of the wearer's foot sole when not under a load.

26. The sole construction set forth in claim 3, wherein articulating joints are formed in the shoe sole that parallel those in the foot by retaining only part of the sole portion material between the heel and the forefoot, except under the base of the fifth metatarsal, which is fully supported like the heel and forefoot; and except for including an upper layer of flexible and inelastic top sole connecting the forefoot, heel, and fifth metatarsal base portions;

an amount of shoe sole material is retained that is sufficient to allow the load-bearing inversion and eversion motion provided said shoe sole by said articulating joints to parallel the inversion and eversion motion of the wearer's foot sole provided by said foot joints;

whereby said shoe sole maintains the full range of inversion and eversion motion of said wearer's foot without restraining it, while also providing stable support to the structural support elements of the foot.

27. The sole construction set forth in claim 26, wherein a shoe side support for the main longitudinal arch is retained.

28. A shoe sole construction for a shoe, comprising:

a shoe sole with an upper, foot sole-contacting surface that conforms to the shape of a wearer's foot sole, including at least part of the curved bottom portion of the foot sole when the foot is non-load-bearing and including at least a portion of a curved side of the foot sole;

and the shoe sole has a constant thickness, when measured in frontal plane cross sections, wherever the shoe sole is directly load-bearing;

the direct load-bearing portion of the shoe sole includes both that part of the curved bottom portion and that part of the curved side portion which become directly load-bearing when the shoe sole on the ground is tilted sideways, away from an upright position;

said shoe sole thickness being defined as the shortest distance between any point on an upper foot sole-contacting surface of said shoe sole and a lower ground-contacting surface of said shoe sole, when measured in frontal plane cross sections;

said thickness varying when measured in the sagittal plane and being greater in a heel area than a forefoot area;

the uniform thickness of the shoe sole extends through at least a contoured side portion providing direct structural support between foot sole and ground through a sideways tilt of at least 45 degrees;

the uniform thickness of the shoe sole is different in at least two frontal plane cross sections wherein the shoe sole has a contoured side portion of at least 45 degrees, so that there are at least two different contoured side portion thicknesses, when measured in frontal plane cross sections;

at least one frontal plane cross section is taken proximate to a head of the wearer's fifth metatarsal and at least one other frontal plane cross section is taken proximate to a base of the wearer's fifth metatarsal;

whereby the constant thickness in frontal plane cross sections, including the side portion, maintains foot stability like when bare, especially during extreme pronation and supination motion.

29. A shoe sole construction for a shoe, comprising:

a shoe sole having an upper, foot-contacting surface that conforms to the shape of a wearer's foot sole, and including a portion of at least a curved side of the foot sole;

and the shoe sole also having a uniform thickness so that a lower, ground-contacting surface parallels said upper surface, when measured in frontal plane cross sections;

the upper and lower surfaces of the shoe sole are parallel, when measured in frontal plane cross sections, wherever the shoe sole is directly load-bearing;

the direct load-bearing portion of the shoe sole includes both that part of the curved bottom portion and that part of the curved side portion which become directly load-bearing when the shoe sole on the ground is tilted sideways, away from an upright position;

said shoe sole including a heel area with a thickness that is greater than a forefoot area;

the uniform thickness of the shoe sole extends through at least a contoured side portion providing direct structural support between foot sole and ground through a sideways tilt of at least 90 degrees;

whereby a constant thickness when in frontal plane cross sections increases maintains foot stability like when bare, especially during extreme pronation and supination motion.

* * * * *